US006738984B2

(12) United States Patent
Gillen et al.

(10) Patent No.: US 6,738,984 B2
(45) **Date of Patent: *May 25, 2004**

(54) PROTECTIVE BODY VEST

(76) Inventors: Sherry S. Gillen, 444 W. Witchwood, Lake Bluff, IL (US) 60044; James G. Gillen, 444 W. Witchwood, Lake Bluff, IL (US) 60044

( * ) Notice: Subject to any disclaimer, the term of this patent is extended or adjusted under 35 U.S.C. 154(b) by 0 days.

This patent is subject to a terminal disclaimer.

(21) Appl. No.: 10/118,676

(22) Filed: Apr. 9, 2002

(65) Prior Publication Data

US 2003/0079271 A1 May 1, 2003

Related U.S. Application Data

(63) Continuation-in-part of application No. 10/000,246, filed on Oct. 29, 2001.

(51) Int. Cl.[7] ..... F41H 1/02; F41H 1/04
(52) U.S. Cl. ..... 2/2.5; 2/455; 2/467
(58) Field of Search ..... 2/455, 456, 459, 2/463, 464, 465, 467, 2.5

(56) References Cited

U.S. PATENT DOCUMENTS

| | | | | | |
|---|---|---|---|---|---|
| 2,756,429 | A | | 7/1956 | Malachowski | |
| 4,100,620 | A | * | 7/1978 | Pecoraro | 2/461 |
| 4,441,211 | A | * | 4/1984 | Donzis | 2/459 |
| 4,668,202 | A | | 5/1987 | Scheurer et al. | |
| 4,697,285 | A | | 10/1987 | Sylvester | |
| 4,884,295 | A | * | 12/1989 | Cox | 2/467 |
| D340,542 | S | | 10/1993 | Marlowe | |
| 5,328,398 | A | | 7/1994 | Aubrey | |
| 5,465,423 | A | * | 11/1995 | Taylor-Varney | 2/462 |
| 5,465,424 | A | | 11/1995 | Cudney et al. | |
| 5,546,602 | A | * | 8/1996 | Hale | 2/462 |
| 5,652,967 | A | * | 8/1997 | Hsu | 2/463 |
| 5,669,080 | A | | 9/1997 | Culton | |
| 6,138,277 | A | * | 10/2000 | Gillen et al. | 2/102 |
| 6,185,738 | B1 | * | 2/2001 | Sidebottom | 2/2.5 |
| 6,446,273 | B1 | * | 9/2002 | Gillen et al. | 2/455 |

* cited by examiner

*Primary Examiner*—John J. Calvert
*Assistant Examiner*—Robert H. Muromoto
(74) *Attorney, Agent, or Firm*—Christopher J. Scott; Charles F. Meroni, Jr.; Meroni & Meroni, P.C.

(57) ABSTRACT

The present invention provides a protective body vest for protecting against impact upon a human torso when worn by an athlete during sporting activities. The protective body vest comprises a multi-section, one-piece garment or vest sized and shaped to be worn on the torso of an athlete. The garment includes multi-layered protective padding that automatically adjusts for varying body sizes and can be customized by the wearer based on safety, comfort and athletic performance concerns. The body vest further comprises a shoulder portion with oversized apertures for receiving a wearer's arms, an anterior portion, a pair of lateral portions and a tapered-design posterior portion. The body vest further comprises at least one opening located off set from the medial line of a wearer's torso and at least one flap or overlap to cover the region of the offset opening as well as the vest area about the offset opening.

142 Claims, 4 Drawing Sheets

PROTECTIVE BODY VEST

This is a Continuation-in-Part Application of U.S. patent application Ser. No. 10/000,246, filed Oct. 29, 2001.

BACKGROUND OF THE INVENTION

1. Field of the Invention

The present invention relates to protective body vests for protecting against impact upon a human torso when worn by an athlete during sporting activities. More specifically, the present invention is primarily intended to provide a baseball/softball player added protection from injuries resulting from being hit by a pitched, thrown, hit or tipped ball, being tagged with a ball or colliding with another player. The present invention can also be utilized by athletes engaged in other sporting activities, such as, but not limited to, inline skating, skateboarding and touch football, to provide added protection from injuries resulting from falling to the ground or colliding with another person or player.

2. Description of the Prior Art

In recent years, many vests have been created for the purpose of providing protection to the torso of an athlete engaged in sporting activities. These vests, however, only afforded protection to limited areas of the body. In particular, U.S. Pat. No. 5,669,080, issued to Culton, discloses a protective apparatus against baseball pitching injuries, which is essentially a partial vest contoured to protect the chest, shoulders, and upper arms of the athlete. Designed primarily for use by baseball/softball umpires, the Protective Apparatus is not conducive to batting, running, throwing, fielding or sliding motions due to the combination of adjustable flexible and non-flexible arm and shoulder straps which secure the apparatus snugly to the arms, shoulders and neck of the wearer, prohibiting the full and easy movement of the arms and neck of an athlete wearing the apparatus, and the protective covering over the upper arms which the apparatus provides. In addition, the degree of protection afforded by the Protective Apparatus from a pitched, hit, thrown or tipped ball, a fall, or a collision is limited since 1) there is no protection for the lateral regions and the back of the torso and 2) the amount of protective material in the apparatus is limited since it is designed to fit under the shirt of an umpire. Designed primarily for use by baseball/softball umpires who would wear the apparatus for an extended period of time (i.e., the duration of a baseball/softball game), the Protective Apparatus is not quickly and easily donned due to the number, location and operation (i.e., any required adjustment for fit) of the securing straps and the fact that the wearer has to put on the vest over his/her head while placing one arm at a time through the arm straps. In particular, to achieve the proper fit of the shoulder strap, the wearer would have to reach around his/her lower back with both hands for the most effective operation of the adjusting mechanism, which is located behind the wearer, unless he/she solicited the help of another person.

Moreover, U.S. Pat. No. 4,668,202, issued to Scheurer et al., and U.S. Pat. No. 5,328,398, issued to Aubrey, both disclose protective vests for flotation utilized in water sporting activities. These vests both have a reduced overall flexibility for other sporting activities due to the relatively rigidity of the vest materials. Further, both of these water vests utilize an exposed center opening for the user to put on the vest, a deep V-neck design and a plurality of securing belts fastened across the center opening. These water vests are primarily designed for flotation purposes and not for protection against impact from sporting activities. As such, these vests do not provide the necessary protection needed for the whole torso. Though the water vests provide some protection against the impact of the water, the combination of the center opening and deep V-neck design exposes the heart of the athlete to impact. Further, the body area below the center opening is unprotected, as the center opening is not covered by protective material. Additionally, the securing belts fastened across the center opening are uncovered, resulting in a possible "catch." Finally, the back of these water vests does not protect the lower spine area of the body from impact forces. In particular, U.S. Pat. No. 4,668,202 contains a rear opening to adjust the vest to the particular body size that leaves the back exposed to impact forces.

It is therefore highly advantageous to provide a protective vest that can provide protection from a multi-section, one-piece garment to the whole torso. In addition, it is advantageous to provide a protective vest that allows for the removal and insertion of the protective padding relative to the wearer's safety, comfort and athletic performance concerns. Additionally, it is advantageous to provide a protective vest that is quickly and easily donned and removed, thus encouraging its use and providing a significant degree of protection to the wearer. Further, it is advantageous to provide a protective vest with an opening or openings off set from the medial line of a human torso to protect against impact to the heart during sporting activities. Still further, it is advantageous for safety reasons to provide an overlap or overlaps and/or a flap or flaps made of protective material to protect the region of the offset opening or offset openings and cover the area of the vest about the offset opening or offset openings. Still further yet, it is advantageous to provide a protective vest with a tapered design in the inferior-most region of the posterior portion to protect the lower spine area of the body from impact, yet permit unhindered movement of the legs. Finally, it is advantageous to provide a protective vest that permits unhindered movement of the arms and neck of the athlete wearing the vest. The present invention provides these and other advantages as is hereinafter explained.

Accordingly, it is a principal object of our invention to provide a multi-section, one-piece garment with multi-layered protective padding to protect the human torso that allows for removal and insertion of the protective padding for safety, comfort and athletic performance concerns, has a tapered design in the inferior-most region of the posterior portion, an offset opening or offset openings and an overlap or overlaps and/or a flap or flaps for health and safety purposes.

It is a further object of our invention to provide a multi-section, one-piece garment with multi-layered protective padding to provide the human torso that allows for removal and insertion of the protective padding for safety, comfort and athletic performance concerns, has a tapered design in the inferior-most region of the posterior portion, an offset opening or offset openings for health and safety purposes.

It is a further object of our invention to provide a multi-section, one-piece garment with multi-layered protective padding to protect the human torso that, being donned and removed in a pull-over manner, eliminates any opening for donning purposes around the torso for health and safety purposes.

It is a still further object of our invention to provide a multi-section, one-piece garment with multi-layered protective padding to protect 1) the anterior region of the human torso or 2) the anterior region and the shoulder region and/or the lateral regions and/or the posterior region of the human torso, that has a posterior portion and/or a shoulder portion and/or lateral portions that allow for the cooling of the underlying torso and, being donned and removed in a pull-over manner, eliminates any opening for donning purposes around the torso for health and safety purposes.

It is a still further object of our invention to provide a multi-section, one-piece garment with multi-layered protective padding to protect 1) the anterior region of the human torso or 2) the anterior region and the shoulder region and/or the lateral regions and/or the posterior region of the human torso, that has a posterior portion and/or a shoulder portion and/or lateral portions that allow for the cooling of the underlying torso, an offset opening or offset openings and an overlap or overlaps and/or a flap or flaps for health and safety purposes.

It is a still further object of our invention to provide a multi-section, one-piece garment with multi-layered protective padding to protect 1) the anterior region of the human torso or 2) the anterior region and the shoulder region and/or the lateral regions and/or the posterior region of the human torso, that has a posterior portion and/or a shoulder portion and/or lateral portions that allow for the cooling of the underlying torso, an offset opening or offset openings for health and safety purposes.

U.S. patent application Ser. No. 10/000,246, filed by Gillen et al., discloses a Protective Body Vest. The subject matter of this specification represents inventive subject matter originating from the same inventive entity as that of U.S. patent application Ser. No. 10/000,246. Further, the subject matter of this specification details significant improvements over that subject matter found in U.S. patent application Ser. No. 10/000,246.

SUMMARY OF THE INVENTION

According to our present invention we have provided a multi-section, one-piece garment for protecting against impact upon a human torso when worn by an athlete during sporting activities comprising a vest sized and shaped to be worn on the torso of an athlete having a multi-layered padding to protect the torso of the athlete. The vest, which is donned and removed in an over-the-head, pullover manner, is comprised generally of a shoulder portion, an anterior portion, a pair of lateral portions and a posterior portion. The multi-layered padding has a first, or outer layer, a second, or middle layer and a third, or inner layer, wherein the first and the third layers sandwich, or are joined at a seam to provide a shell for, the second layer, the second layer being formed from a padding material for protecting the torso against impact.

The multi-layered padding in the shoulder portion is sized, shaped and constructed to provide protection against impact to the shoulder area, and unhindered movement of the arms and neck. The shoulder portion further has a pair of oversized apertures located at the lateral most regions for receiving the arms, each oversized aperture being sized and shaped to permit full movement of the arm.

The shoulder portion may further have a right section and a left section of the shoulder portion each being comprised of either 1) an anterior section and a posterior section, the respective anterior and posterior sections of the right and left shoulder sections overlapping or interlocking, the overlap or interlock being secured by a fastening device or devices to hold the respective anterior and posterior sections of the right and left shoulder sections together, the overlap or interlock being adjustable to provide for a change in the vest length, 2) an anterior section, a posterior section and a middle section, the respective anterior and posterior sections of the right and left shoulder sections overlapping or interlocking with the middle section, the overlap or interlock being secured by a fastening device or devices to hold the respective anterior, posterior and middle sections of the right and left shoulder sections together, the overlap or interlock being adjustable to provide for a change in the vest length or 3) an anterior section, a posterior section and a middle section, the respective anterior and posterior sections of the right and left shoulder sections overlapping or interlocking with the middle section, the respective anterior and posterior sections of the right and left shoulder sections being capable of overlapping or interlocking with each other, the overlap or overlaps or interlock or interlocks being secured by a fastening device or devices to hold the respective anterior, posterior and middle sections of the right and left shoulder sections together, the overlap or overlaps or interlock or interlocks being adjustable to provide for a change in the vest length.

The anterior portion of the vest has the multi-layered padding sized, shaped and constructed to provide protection against impact to the abdomen, heart, spleen and chest and allow unhindered movement of the legs. The anterior portion may further have the first and third layers of the multi-layered padding, or a portion or portions and/or a layer or layers and/or a section or sections thereof, being comprised of air-permeable and/or moisture-control/wicking material. The inferior-most region of the anterior portion may further be shaped in either a short taper to protect the lower abdomen and allow unhindered movement of the legs, or a long taper to protect the lower abdomen and allow unhindered movement of the legs. The tapered section of the anterior portion, or the bottom part thereof, may further be removable from the vest, being fastened to the vest by a fastening device or devices.

The pair of lateral portions of the vest are located inferior to the pair of oversized apertures wherein each lateral portion has the multi-layered padding sized, shaped and constructed to provide protection against impact to the lateral regions, and unhindered movement of the legs.

The posterior portion of the vest has the multi-layered padding sized, shaped and constructed to provide protection to the back and unhindered movement of the legs. The posterior portion may further have the first and third layers of the multi-layered padding, or a portion or portions and/or a layer or layers and/or a section or sections thereof, being comprised of air-permeable and/or moisture-control/wicking material to allow for the cooling of the underlying torso. The posterior portion may further comprise at least one holder or fastener for securing a removable strip of fabric or flag, such as a "flag football" flag. The inferior-most region of the posterior portion may further be shaped in either a short taper to protect the back and allow the unhindered movement of the legs, or a long taper to provide protection to the lower spine area and allow unhindered movement of the legs. The tapered section of the posterior portion, or the bottom part thereof, may further be removable from the vest, being fastened to the vest by a fastening device or devices.

The present invention may further comprise at least one slot or opening on the interior or exterior surface or the first or third layer of the multi-layered padding, or in the seam where the first and third layers are joined to form the shell, which may or may not have a fastening device or devices to secure it in a closed position, allowing for removal or insertion of the second, or middle layer or the multi-layered padding, or a layer or layers, or a portion or portions, or a section or sections thereof, from the vest.

The lateral most edges of the second layer of the multi-layered padding in the anterior portion and/or posterior portion of the vest, or a layer thereof, may extend over and/or overlap in the pair of lateral portions of the vest in order to maintain a second layer of the multi-layered padding between the first and third layers in the pair of lateral portions of the vest as the vest stretches horizontally to accommodate larger torso sizes.

The present invention may further have the second, or middle layer of the multi-layered padding being formed from polymeric cellular foam material for protecting against impact to the torso. The present invention may further have the first and/or second and/or third layers of the multi-layered padding, or a portion or portions, or a section or sections thereof, being comprised of multiple layers. The present invention may further have the multi-layered padding, or a portion or portions, or a layer or layers, or a section or sections thereof, being punctuated with a plurality of air holes to provide for the cooling of the underlying torso. The present invention may further have the second layer of the multi-layered padding, or a portion or portions and/or a layer or layers and/or a section or sections thereof, comprised of air-permeable and/or moisture-control/wicking material to provide for the cooling of the underlying torso.

The present invention may further comprise at least one single or multi-part adjustable securing belt-like device such as a belt, strap or drawstring wrapped around the multi-layered padding, or partially thereof, on the first, or outer layer, the second, or middle layer, or a layer thereof, or the first and second layer alternately, of the vest to secure the vest about the torso, the adjustable securing belt-like device being fastened to the vest by a fastening means and/or inserted through a vertical loop or loops and/or a slot or slots and/or an opening or openings, the vertical loop or loops being attached to the vest and the slot or slots and/or opening or openings being located in the first, or outer layer and/or the third, or inner layer of the vest to hold the adjustable securing belt-like device around the torso, the adjustable securing belt-like device being fastened by a belt-like device fastener or fasteners.

The present invention may further have a protective pad or pads comprising rigid, semi-rigid or flexible material affixed onto, and/or inserted into a pocket on, the interior and/or exterior surface of the first, or outer layer of the multi-layer padding, and/or the interior and/or exterior surface of the second, or middle layer of the multi-layered padding, or a layer thereof, and/or the interior and/or exterior surface of the third, or inner layer of the multi-layered padding of the anterior portion and sized and shaped to provide protection from impact to the heart and/or spleen.

The present invention may further have an inferior section and a superior section of the anterior portion and/or the lateral portions and/or the posterior portion overlapping, interlocking, or abutting, the overlap, interlock or abutment being secured by a fastening device or devices to attach the inferior section and the superior section together, the fastening device or devices allowing for the removal of the inferior section to change the vest length and/or the overlap, interlock or abutment, and the related fastening device or devices securing the overlap, interlock or abutment, being adjustable to change the vest length.

In another embodiment, we have provided a multi-section, one-piece garment that is donned and removed in an over-the-head, pullover manner, for protecting against impact upon a human torso when worn by an athlete during sporting activities comprising a vest sized and shaped to be worn on a torso of an athlete including an anterior portion, a posterior portion, a pair of lateral portions and a shoulder portion, the vest having a multi-layered padding in the anterior portion and/or the shoulder portion and/or the lateral portions and/or the posterior portion of the vest, the shoulder portion and/or the lateral portions and/or the posterior portion of the vest being comprised primarily, if not totally of material that allows for the cooling of the underlying torso. The multi-layered padding has a first, or outer layer, a second, or middle layer and a third, or inner layer wherein the first layer and the third layer sandwich, or are joined at a seam to provide a shell for, the second layer, the second layer being formed from a padding material.

The shoulder portion has a pair of oversized apertures located at the lateral most regions for receiving the arms, each oversized aperture being sized and shaped to permit full movement of the arm.

The posterior portion and the anterior portion may each further comprise at least one fastener therein to be connected by a strap, therein to engage the posterior portion of the vest to the anterior portion to achieve a more secure, more contoured fit.

In another embodiment of the vest, we have provided a multi-section, one-piece garment for protecting against impact upon a human torso when worn by an athlete during sporting activities comprising a vest sized and shaped to be worn on a torso of an athlete including an anterior portion, a posterior portion, a pair of lateral portions, a shoulder portion and an offset opening or offset openings, the vest having a multi-layered padding in the anterior portion and the shoulder portion and/or the lateral portions and/or the posterior portion of the vest, the posterior portion and/or the lateral portions and/or the shoulder portion of the vest being comprised primarily, if not totally of material that allows for the cooling of the underlying torso. The multi-layered padding has a first, or outer layer, a second, or middle layer and a third, or inner layer wherein the first layer and the third layer sandwich, or are joined at a seam to provide a shell for, the second layer, the second layer being formed from a padding material. The offset opening or offset openings is/are offset from the medial line of a human torso to protect the heart against impact. The present invention further comprises a fastening device or devices to engage the vest when fastened to secure the vest about the torso.

The present invention may further comprise an overlap or overlaps and/or a flap or flaps that extends or is located over the offset opening or offset openings and sized and shaped to protect the region of the offset opening or offset openings against impact and cover the area of the vest about the offset opening or offset openings. The overlap or overlaps and/or flap or flaps extends from or is attached to the vest and fastened across the offset opening or offset openings by a fastening device or devices, the fastening device or devices either supplementing or supplanting the fastening device or devices fastened to secure the vest about the torso.

The overlap or overlaps and/or the flap or flaps may further contain at least one fastener attached on its exterior surface and correspondingly on the exposed exterior surface to secure the overlap or overlaps and/or the flap or flaps in an open position on the vest in order to facilitate the donning of the vest.

In another embodiment of the vest, we have provided a multi-section, one-piece garment for protecting against impact upon a human torso when worn by an athlete during sporting activities comprising a vest sized and shaped to be worn on the torso of an athlete having a multi-layered padding to protect the torso of the athlete. The vest is comprised generally of a shoulder portion, an anterior portion, a pair of lateral portions, a posterior portion and an offset opening or offset openings. The multi-layered padding has a first, or outer layer, a second, or middle layer and a third, or inner layer, wherein the first and the third layers sandwich, or are joined at a seam to provide a shell for, the second layer, the second layer being formed from a padding material for protecting the torso against impact. The offset opening or offset openings is/are off set from the medial line of a human torso to protect the heart against impact. The present invention further comprises a fastening device or devices to engage the vest when fastened to secure the vest about the torso.

The present invention may further comprise an overlap or overlaps and/or a flap or flaps that extends or is located over the offset opening or offset openings and sized and shaped to protect the region of the offset opening or offset openings against impact and cover the area of the vest about the offset opening or offset openings. The overlap or overlaps and/or the flap or flaps extends from or is attached to the vest and fastened across the offset opening or offset openings by a fastening device or devices, the fastening device or devices either supplementing or supplanting the fastening device or devices fastened to secure the vest about the torso.

The overlap or overlaps and/or the flap or flaps may further contain at least one fastener attached on its exterior surface and correspondingly on the exposed exterior surface to secure the overlap or overlaps and/or the flap or flaps in an open position on the vest in order to facilitate the donning of the vest.

The multi-layered padding in the shoulder portion is sized, shaped and constructed to provide protection against impact to the shoulder area, and unhindered movement of the arms and neck. The shoulder portion further has a pair of oversized apertures located at the lateral most regions for receiving the arms, each oversized aperture being sized and shaped to permit full movement of the arm.

The shoulder portion may further have a right section and a left section of the shoulder portion each being comprised of either 1) an anterior section and a posterior section, the respective anterior and posterior sections of the right and left shoulder sections overlapping or interlocking, the overlap or interlock being secured by a fastening device or devices to hold the respective anterior and posterior sections of the right and left shoulder sections together, the overlap or interlock being adjustable to provide for a change in the vest length, 2) an anterior section, a posterior section and a middle section, the respective anterior and posterior sections of the right and left shoulder sections overlapping or interlocking with the middle section, the overlap or interlock being secured by a fastening device or devices to hold the respective anterior, posterior and middle sections of the right and left shoulder sections together, the overlap or interlock being adjustable to provide for a change in the vest length or 3) an anterior section, a posterior section and a middle section, the respective anterior and posterior sections of the right and left shoulder sections overlapping or interlocking with the middle section, the respective anterior and posterior sections of the right and left shoulder sections being capable of overlapping or interlocking with each other, the overlap or overlaps or interlock or interlocks being secured by a fastening device or devices to hold the respective anterior, posterior and middle sections of the right and left shoulder sections together, the overlap or overlaps or interlock or interlocks being adjustable to provide for a change in the vest length.

The anterior portion of the vest has the multi-layered padding sized, shaped and constructed to provide protection against impact to the abdomen, heart, spleen and chest and allow unhindered movement of the legs. The anterior portion may further have the first and third layers of the multi-layered padding, or a portion or portions and/or a layer or layers and/or a section or sections thereof, being comprised of air-permeable and/or moisture-control/wicking material. The inferior-most region of the anterior portion may further be shaped in either a short taper to protect the lower abdomen and allow unhindered movement of the legs, or a long taper to protect the lower abdomen and allow unhindered movement of the legs. The tapered section of the anterior portion, or the bottom part thereof, may further be removable from the vest, being fastened to the vest by a fastening device or devices.

The pair of lateral portions of the vest are located inferior to the pair of oversized apertures wherein each lateral portion has the multi-layered padding sized, shaped and constructed to provide protection against impact to the lateral regions, and unhindered movement of the legs.

The posterior portion of the vest has the multi-layered padding sized, shaped and constructed to provide protection to the back and unhindered movement of the legs. The posterior portion may further have the first and third layers of the multi-layered padding, or a portion or portions and/or a layer or layers and/or a section or sections thereof, being comprised of air-permeable and/or moisture-control/wicking material to allow for the cooling of the underlying torso. The posterior portion may further comprise at least one holder or fastener for securing a removable strip of fabric or flag, such as a "flag football" flag. The inferior-most region of the posterior portion may further be shaped in either a short taper to protect the back and allow the unhindered movement of the legs, or a long taper to provide protection to the lower spine area and allow unhindered movement of the legs. The tapered section of the posterior portion, or the bottom part thereof, may further be removable from the vest, being fastened to the vest by a fastening device or devices.

The present invention may further comprise at least one slot or opening on the interior or exterior surface or the first or third layer of the multi-layered padding, or in the seam where the first and third layers are joined to form the shell, which may or may not have a fastening device or devices to secure it in a closed position, allowing for removal or insertion of the second, or middle layer of the multi-layered padding, or a layer or layers, or a portion or portions, or a section or sections thereof, from the vest.

The lateral most edges of the second layer of the multi-layered padding in the anterior portion and/or posterior portion of the vest, or a layer thereof, may extend over and/or overlap in the pair of lateral portions of the vest in order to maintain a second layer of the multi-layered padding between the first and third layers in the pair of lateral portions of the vest as the vest stretches horizontally to accommodate larger torso sizes.

The present invention may further have the second, or middle layer of the multi-layered padding being formed from polymeric cellular foam material for protecting against impact to the torso. The present invention may further have the first and/or second and/or third layers of the multi-layered padding, or a portion or portions, or a section or sections thereof, being comprised of multiple layers. The present invention may further have the multi-layered padding, or a portion or portions, or a layer or layers, or a section or sections thereof, being punctuated with a plurality of air holes to provide for the cooling of the underlying torso. The present invention may further have the second layer of the multi-layered padding, or a portion or portions and/or a layer or layers and/or a section or sections thereof, comprised of air-permeable and/or moisture-control/wicking material to provide for the cooling of the underlying torso.

The present invention may further comprise at least one single or multi-part adjustable securing belt-like device such as a belt, strap or drawstring wrapped around the multi-layered padding, or partially thereof, on the first, or outer layer, the second, or middle layer, or a layer thereof, or the first and second layer alternately, of the vest to secure the vest about the torso, the adjustable securing belt-like device being fastened to the vest by a fastening means and/or inserted through a vertical loop or loops and/or a slot or slots and/or an opening or openings, the vertical loop or loops being attached to the vest and the slot or slots and/or opening or openings being located in the first, or outer layer and/or the third, or inner layer of the vest to hold the adjustable securing belt-like device around the torso, the adjustable securing belt-like device being fastened by a belt-like device fastener or fasteners.

The present invention may further have a protective pad or pads comprising rigid, semi-rigid or flexible material affixed onto, and/or inserted into a pocket on, the interior and/or exterior surface of the first, or outer layer of the multi-layer padding, and/or the interior and/or exterior surface of the second, or middle layer of the multi-layered padding, or a layer thereof, and/or the interior and/or exterior surface of the third, or inner layer of the multi-layered padding of the anterior portion and sized and shaped to provide protection from impact to the heart and/or spleen.

The present invention may further have an inferior section and a superior section of the anterior portion and/or the lateral portions and/or the posterior portion overlapping, interlocking, or abutting, the overlap, interlock or abutment being secured by a fastening device or devices to attach the inferior section and the superior section together, the fastening device or devices allowing for the removal of the inferior section to change the vest length and/or the overlap, interlock or abutment, and the related fastening device or devices securing the overlap, interlock or abutment, being adjustable to change the vest length.

Each of the embodiments of the invention described above can utilize a cooling fabric such as HYDROWEAVE® in either the third, or inner layer of the multi-layer padding or in those portions of the vest that are specified in the claims as being comprised primarily, if not totally of material that provides for the cooling of the underlying torso. In either case, as specified in the claims, the cooling fabric may be removable from the vest to facilitate the cooling of the fabric prior to use.

Each of the embodiments of the invention described above can, with the following slight modifications, be worn by a mature female athlete: incorporating a convex configuration in the superior region of the anterior portion, and in the superior region of the flap/flaps or overlap/overlaps for those embodiments that include the flap/flaps or overlap/overlaps, for receiving the female breasts and incorporating a concave configuration in the inferior-most regions of the pair of lateral portions for receiving the female hips.

Other objects of our invention, as well as particular features, elements, and advantages thereof, will be elucidated in, or apparent from, the following description and the accompanying drawing figures.

DESCRIPTION OF THE DRAWINGS

Other features of my invention will become more evident from a consideration of the detailed description of my patent drawings, as follows.

DETAILED DESCRIPTION

Figure 1:
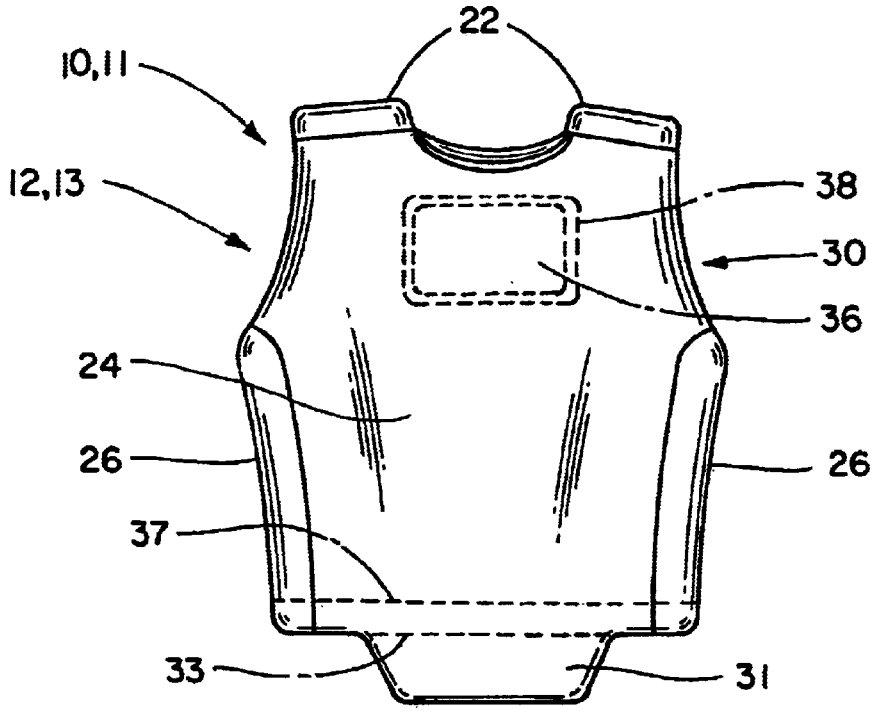
FIG. 1 is a front view of both the preferred embodiment of the pullover version of the vest and an alternative embodiment of the pullover version of the vest that utilizes material in the posterior portion that provides for the cooling of the underlying torso.

Referring now to the drawings, the present invention comprises a multi-section, one-piece garment 10 for protecting against impact upon a human torso when worn by an athlete during sporting activities. The multi-section, one-piece garment 10, which is donned and removed in an over-the-head, pullover manner, comprises of a vest 12 sized and shaped to be worn on a torso by an athlete having a multi-layer padding to protect the torso of the athlete, including a shoulder portion 22, an anterior portion 24, a pair of lateral portions 26 and a posterior portion 28, as shown in FIGS. 1 and 2.

The multi-layered padding contains a first, or outer layer, a second, or middle layer and a third, or inner layer. The first layer and the third layer of the multi-layered padding sandwich, or are joined at a seam to provide a shell for, the second, or middle layer, the second layer being formed from a padding material. As is common practice, a welting may be inserted in the seam where the first layer and third layer are joined to form the shell. Excellent results are obtained when second layer of the multi-layered padding in made from polymeric cellular foam similar in texture, sponginess, flexibility, pliability, resiliency and strength resilience to Polyethylene or Polyvinyl Chloride. Further excellent results are obtained when the second layer of the multi-layered padding, or a portion or portions and/or a layer or layers and/or a section or sections thereof, is punctuated with a plurality of air holes and/or is comprised of air-permeable and/or moisture-control/wicking material to provide for the cooling of the underlying torso.

In order for an athlete to perform optimally, unhindered movement of the arms and neck is necessary. Accordingly, as shown in FIGS. 1 and 2, the shoulder portion 22 has the multi-layered padding sized and shaped to provide protection against impact to the shoulder area and unhindered movement of the arms and neck. The shoulder portion 22 further contains a pair of oversized apertures 30 as shown in FIGS. 1 and 2, leaving the shoulder area in an unhindered condition and allowing full movement of the arms.

Figure 2:
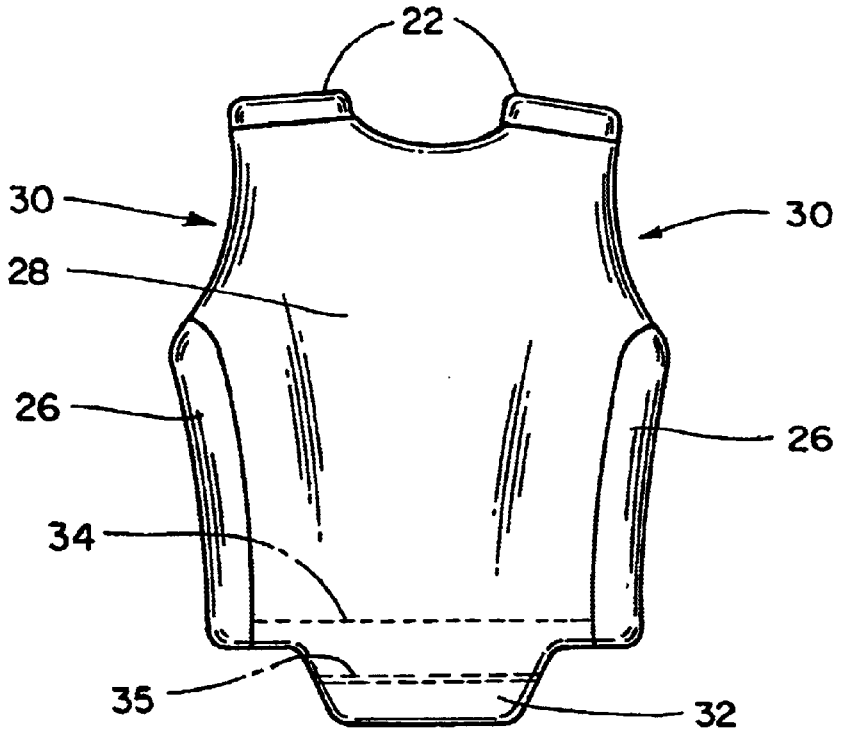
FIG. 2 is a view of the posterior portion of both the preferred embodiment of the pullover version of the vest and of the preferred embodiment of the offset-opening/openings version of the vest that incorporates two offset openings.

As shown in FIG. 1, the anterior portion 24 has the multi-layered padding sized and shaped to allow unhindered movement of the legs and to provide protection against impact to the chest, heart, spleen and abdomen. The anterior portion 24 further has the first layer and the third layer of the multi-layered padding being formed from an air-permeable, moisture-control/wicking material to allow for the cooling of the underlying torso. Excellent results are obtained when the material in the first layer and the third layer of the multi-layered padding is made from a fabric similar in texture, durability, air permeability and moisture-wicking capability of CORDURA Nylon or COOLMAX.

As shown in FIG. 1, the anterior portion 24 is further shaped in a tapered design 31 in the inferior-most region to protect the lower abdomen and allow unhindered movement of the legs. As depicted in FIG. 1 by the dotted line 33, the tapered section 31 of the anterior portion 24 is removable from the vest, being fastened to the vest by a fastening device (hidden from view). Excellent results are obtained when the fastening device is comprised of VELCRO.

As shown in FIGS. 1 and 2, the pair of lateral portions 26 further protects the torso by having the multi-layered padding sized, shaped and constructed to provide protection from impact to the lateral regions and unhindered movement of the legs.

As shown in FIG. 2, the posterior portion 28 further protects the torso by having the multi-layered padding sized and shaped to provide protection from impact to the back. In order to provide both protection to the lower spine area and unhindered movement of the legs, the posterior portion 28 is shaped in a tapered design 32 in the inferior-most region. As depicted in FIG. 2 by the dotted line 35, the bottom part of the tapered section 32 of the posterior portion 28 is removable from the vest, being fastened to the vest by a fastening device (hidden from view). Excellent results are obtained when the fastening device is comprised of VELCRO.

As shown in FIG. 2, in order to enable the athlete to customize the protective padding for safety, comfort or athletic performance purposes, the posterior portion 28 further contains a slot or opening 34 on the interior or exterior surface or the first layer or the third layer of the multi-layered padding allowing for the removal or insertion of the second layer, or a layer or layers thereof, from the vest 12. The posterior portion 28 further has the first layer and the third layer of the multi-layered padding being formed from an air-permeable, moisture-wicking material to allow for the cooling of the underlying torso. Excellent results are obtained when the material in the first layer and the third layer of the multi-layered padding is made from a fabric similar to texture, durability, air permeability and moisture-wicking capability to CORDURA Nylon or COOLMAX.

As shown in FIG. 1, the present invention further has at least one protective pad 36 comprising rigid, semi-rigid or flexible material inserted into a pocket 38 on, the interior or exterior surface of the first, or outer layer of the multi-layered padding, or affixed onto the exterior surface of the second, or middle layer of the multi-layered padding, in the superior region of the anterior portion 24 and sized and shaped to provide protection from impact to the heart. Excellent results are obtained when the protective pad 36 is comprised of polyethylene foam or thermoplastic polymer-based material.

As depicted in FIG. 1 by the dotted line 37, the present invention further has the inferior regions of the anterior portion, the posterior portion and the lateral portions being both removable and adjustable to change the length of the vest, being fastened to the vest by a fastening device (hidden from view). Excellent results are obtained when the fastening device is comprised of VELCRO.

The present invention may further have at least one single or multi-part adjustable securing belt-like device such as a belt, strap or drawstring wrapped around the multi-layered padding, or partially thereof, on the first, or outer layer, the second, or middle layer, or a layer thereof, or the first and second layer alternately, of the vest to secure the vest about the torso, the adjustable securing belt-like device being fastened to the vest by a fastening means and/or inserted through a vertical loop or loops and/or a slot or slots and/or an opening or openings, the vertical loop or loops being attached to the vest and the slot or slots and/or opening or openings being located in the first, or outer layer and/or the third, or inner layer of the vest to hold the adjustable securing belt-like device around the torso, the adjustable securing belt-like device being fastened by a belt-like device fastener or fasteners. Excellent results are obtained when either 1) one or two two-part, adjustable securing belts are located on each side of the vest, the belts not extending completely across either the front or back of the vest, each belt being fastened to the vest at the opposite ends of the belt by either stitching, a tack or tacks, a fastening device such as a snap or button, or another fastening device or means, the two parts of each belt being fastened together by a ladder-lock fastener whereby one part of the belt is stitched to the ladderlock and the other part of the belt loops through the ladderlock to effect the fastening, the ladderlock fastener allowing the belt to be adjusted to secure the vest on the torso or 2) one or two three-part adjustable securing belts are wrapped around the side and back of the vest, the belts not extending completely across the front of the vest, the belts either running on top of the outer layer of the vest or, utilizing slots in the outer layer, that portion of the middle part of the each belt running across the back diving under the outer layer, each belt being fastened to the vest at the opposite ends of the belt by either stitching, a tack or tacks, a fastening device such as a snap or button, or another fastening device or means, the middle part of the bell being fastened to the two end parts of the belt that are fastened to the vest by ladderlock fasteners to effect the fastening, the ladderlock fasteners allowing the belt to be adjusted to secure the vest on the torso.

Figure 3:
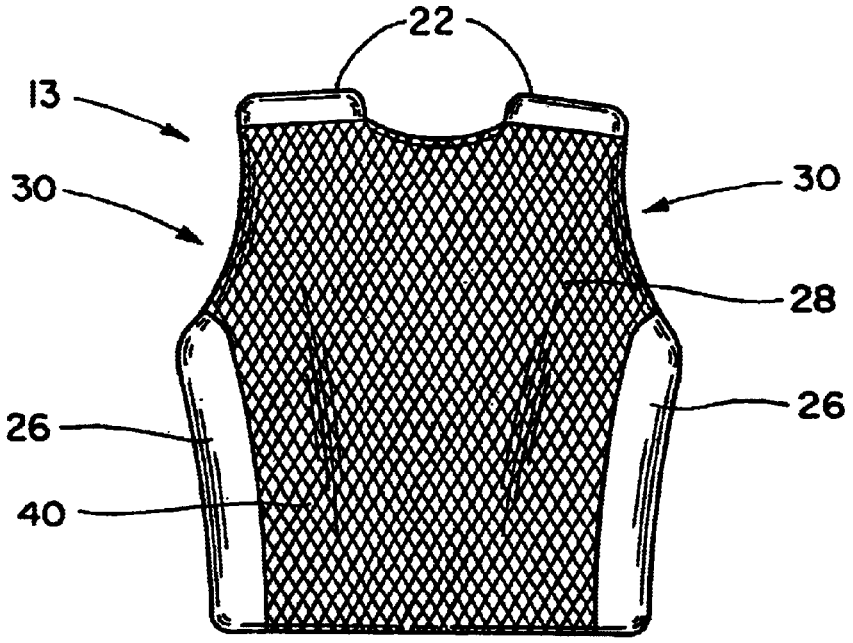
FIG. 3 is a posterior view of two alternative embodiments of the vest: an alternative embodiment of the pullover version of the vest that utilizes material in the posterior portion that provides for the cooling of the underlying torso, and an alternative embodiment of the version of the vest that includes two offset openings and utilizes material in the posterior portion that provides for the cooling of the underlying torso.

In another embodiment, the present invention is comprised of a multi-section, one-piece garment 11 for protecting against impact upon a human torso when worn by an athlete during sporting activities. The multi-section, one-piece garment 11, which is donned and removed in an over-the-head, pullover manner, comprises of a vest 13 sized and shaped to be worn on a torso by an athlete including an anterior portion 24, a posterior portion 28, a pair of lateral portions 26 and a shoulder portion 22 as shown in FIGS. 1 and 3, the vest 13 having a multi-layered padding in the anterior portion 24, the shoulder portion 22 and the pair of lateral portions 26 to protect the torso of the athlete engaged in a sporting activity, the posterior portion 28 of the vest being comprised primarily, if not totally of material 40 that provides for the cooling of the underlying torso, as shown in FIG. 3. Excellent results are obtained when the material 40 that provides for the cooling of the underlying torso is comprised of either a mesh-type material or a cooling fabric such as HYDROWEAVE®.

As shown in FIGS. 1 and 3, the shoulder portion 22 has the multi-layered padding sized and shaped to provide protection to the shoulder area and unhindered movement of the arms and neck. The shoulder portion 22 further contains a pair of oversized apertures 30, leaving the shoulder area in an unhindered condition and allowing full movement of the arms. An alternative version of this embodiment of the vest has the shoulder portion 22, in addition to the posterior portion 28, being comprised primarily, if not totally of material that provides for the cooling of the underlying torso.

As shown in FIG. 1, the anterior portion 24 has the multi-layered padding sized and shaped to allow unhindered movement of the legs and provide protection against impact to the chest, heart spleen and abdomen. As is also shown in FIG. 1, the anterior portion 24 is further shaped in a tapered design 31 in the inferior-most region to protect the lower abdomen and allow unhindered movement of the legs. As depicted in FIG. 1 by the dotted line 33, the tapered section 31 of the anterior portion 24 is removable from the vest, being fastened to the vest by a fastening device (hidden from view). Excellent results are obtained when the fastening device is comprised of VELCRO.

As shown in FIGS. 1 and 3, the pair of lateral portions 26 further protects the athlete's torso by having the multi-layered padding sized and shaped to provide protection from impact to the lateral regions and unhindered movement of the legs.

As shown in FIG. 1, the present invention further has at least one protective pad 36 comprising rigid, semi-rigid or flexible material inserted into a pocket 38 on, the interior or exterior surface of the first, or outer layer of the multi-layered padding, or affixed onto the exterior surface of the second, or middle layer of the multi-layered padding, in the superior region of the anterior portion 24 and sized and shaped to provide protection from impact to the heart. Excellent results are obtained when the protective pad 36 is comprised of polyethylene foam or thermoplastic polymer-based material.

As depicted in FIG. 1 by the dotted line 37, the present invention further has the inferior regions of the anterior portion, the posterior portion and the lateral portions being both removable and adjustable to change the length of the vest, being fastened to the vest by a fastening device (hidden from view). Excellent results are obtained when the fastening device is comprised of VELCRO.

Figure 4:
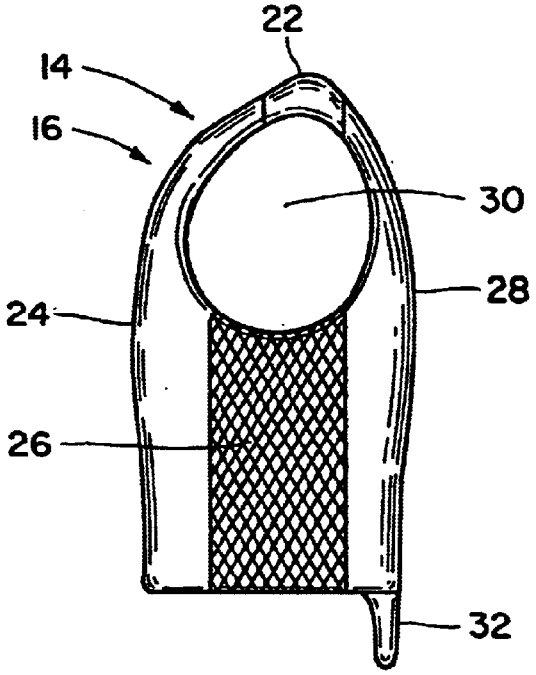
FIG. 4 is a side view of an alternative embodiment of the pullover version of the vest that utilizes material in both the posterior and lateral portions that provides for the cooling of the underlying torso.

In another embodiment, the present invention is comprised of a multi-section, one-piece garment 14 for protecting against impact upon a human torso when worn by an athlete during sporting activities. The multi-section, one-piece garment 14, which is donned and removed in an over-the-head, pullover manner, comprises of a vest 16 sized and shaped to be worn on a torso by an athlete including an anterior portion 24, a posterior portion 28, a pair of lateral portions 26 and a shoulder portion 22, as shown in FIG. 4, the vest 16 having a multi-layered padding in the anterior portion 24, the shoulder portion 22 and the posterior portion 28 to protect the torso of the athlete engaged in a sporting activity, the pair of lateral portions 26 of the vest being comprised primarily, if not totally of material 40 that provides for the cooling of the underlying torso, as shown in FIG. 4. Excellent results are obtained when the material 40 that provides for the cooling of the underlying torso is comprised of either a mesh-type material or a cooling fabric such as HYDROWEAVE®.

As shown in FIG. 4, the shoulder portion 22 has the multi-layered padding sized and shaped to provide protection to the shoulder area and unhindered movement of the arms and neck. The shoulder portion 22 further contains a pair of oversized apertures 30, leaving the shoulder area in an unhindered condition and allowing full movement of the arms. An alternative version of this embodiment of the vest has the shoulder portion 22, in addition to the pair of lateral portions 26, being comprised primarily, if not totally of material that provides for the cooling of the underlying torso.

Figure 8:
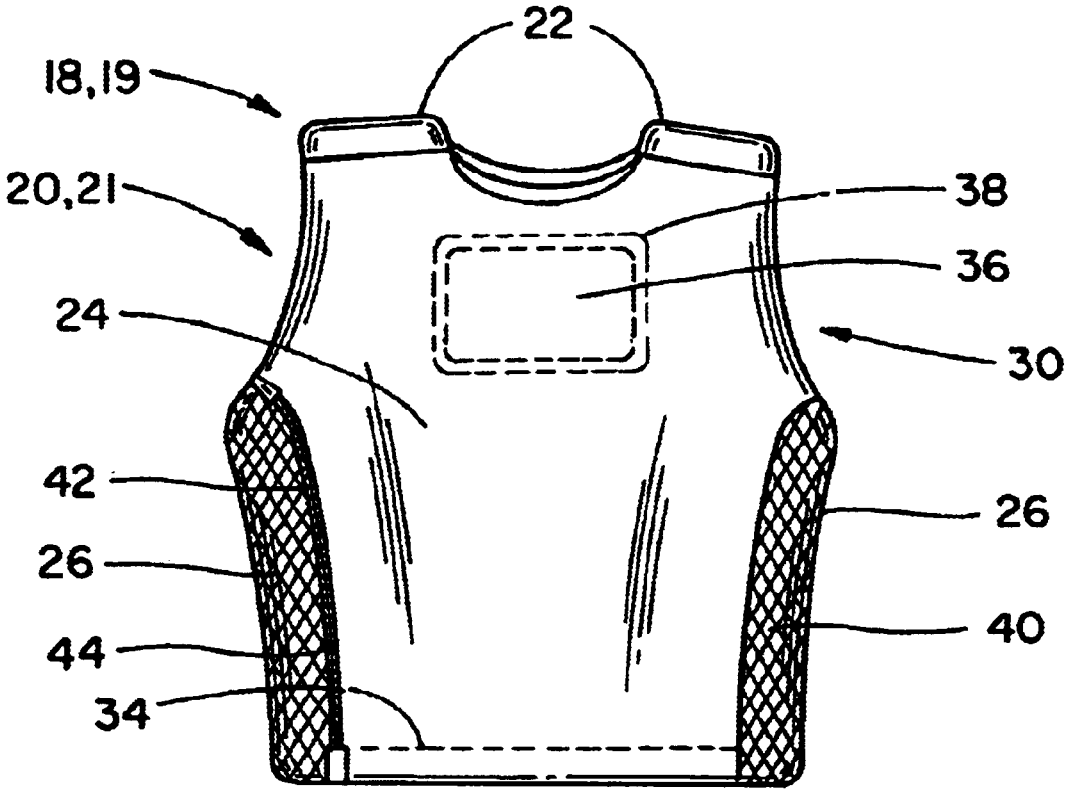
FIG. 8 is a front view of two alternative embodiments of the vest: an alternative embodiment of the vest that has an offset opening and utilizes material in the lateral portions that provides for the cooling of the underlying torso, and an alternative embodiment of the vest that has an offset opening and utilizes material in both the posterior and lateral portions that provides for the cooling of the underlying torso.

The anterior portion 24 of this embodiment of the pull-over vest 16 would, except for the offset opening 42 and zipper fastener 44 depicted, appear identical while on the torso to the anterior portion 24 shown in FIG. 8. As shown in FIG. 8, the anterior portion 24 has the multi-layered padding sized and shaped to allow unhindered movement of the legs and provide protection against impact to the chest, heart spleen and abdomen. The anterior portion 24 further has a slot or opening 34 on the interior or exterior surface of the first layer or the third layer of the multi-layered padding allowing for the removal or insertion of the second layer of the multi-layered padding, or a layer or layers thereof, from the vest 16.

As shown in FIG. 4, the posterior portion 28 further protects the torso by having the multi-layered padding sized and shaped to provide protection from impact to the back. In order to provide both protection to the lower spine area and unhindered movement of the legs, the posterior portion 28 is shaped in a tapered design 32 in the inferior-most region.

Again referring to FIG. 8, the present invention further has at least one protective pad 36 comprising rigid, semi-rigid or flexible material inserted into a packet 38 on, the interior or exterior surface of the first, or outer layer of the multi-layer padding, or affixed onto the exterior surface of the second, or middle layer of the multi-layered padding, in the superior region of the anterior portion 24 and sized and shaped to provide protection from impact to the heart. Excellent results are obtained when the protective pad 36 is comprised of polyethylene foam or thermoplastic polymer-based material.

Figure 5:
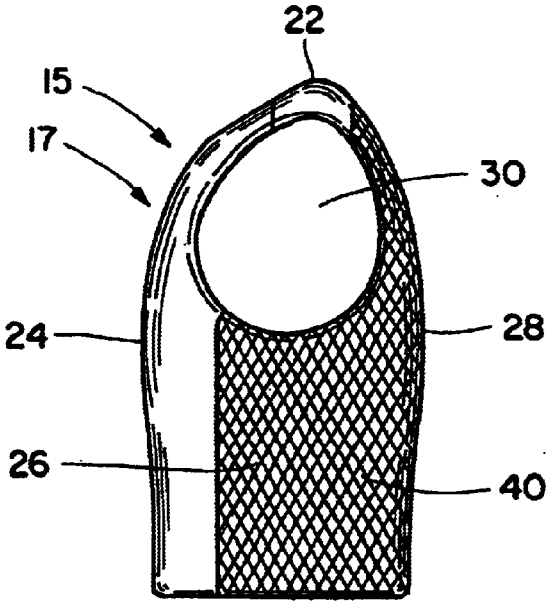
FIG. 5 is a side view of an alternative embodiment of the pullover version of the vest that utilizes material in the lateral portions that provides for the cooling of the underlying torso.

In another embodiment, the present invention is comprised of a multi-section, one-piece garment 15 for protecting against impact upon a human torso when worn by an athlete during sporting activities. The multi-section, one-piece garment 15, which is donned and removed in an over-the-head, pullover manner, comprises of a vest 17 sized and shaped to be worn on a torso by an athlete including an anterior portion 24, a posterior portion 28, a pair of lateral portions 26 and a shoulder portion 22, as shown in FIG. 5, the vest 17 having a multi-layered padding in the anterior portion 24 and the shoulder portion 22 to protect the torso of the athlete engaged in a sporting activity, the posterior portion 28 and pair of lateral portions 26 of the vest being comprised primarily, if not totally of material 40 that provides for the cooling of the underlying torso, as shown in FIG. 5. Excellent results are obtained when the material 40 that provides for the cooling of the underlying torso is comprised of either a mesh-type material or a cooling fabric such as HYDROWEAVE®.

As shown in FIG. 5, the shoulder portion 22 has the multi-layered padding sized and shaped to provide protection to the shoulder area and unhindered movement of the arms and neck. The shoulder portion 22 further contains a pair of oversized apertures 30, leaving the shoulder area in an unhindered condition and allowing full movement of the arms. An alternative version of this embodiment of the vest has the shoulder portion 22, in addition to the posterior portion 28 and the pair of lateral portions 26, being comprised primarily, if not totally of material that provides for the cooling of the underlying torso.

The anterior portion 24 of this embodiment of the pullover vest 17 would, except for the offset opening 42 and zipper fastener 44 depicted, appear identical to the anterior portion 24 shown in FIG. 8 while on the torso. As shown in FIG. 8, the anterior portion 24 has the multi-layered padding sized and shaped to allow unhindered movement of the legs and provide protection against impact to the chest, heart spleen and abdomen. The anterior portion 24 further has a slot or opening 34 on the interior or exterior surface of the first layer or the third layer of the multi-layered padding allowing for the removal or insertion of the second layer of the multi-layered padding, or a layer or layers thereof, from the vest 17.

Again referring to FIG. 8, the present invention further has at least one protective pad 36 comprising rigid, semi-rigid or flexible material inserted into a pocket 38 on, the interior or exterior surface of the first, or outer layer of the multi-layered padding, or affixed onto the exterior surface of the second, or middle layer of the multi-layered padding, in the superior region of the anterior portion 24 and sized and shaped to provide protecting from impact to the heart. Excellent results are obtained when the protective pad 36 is comprised of polyethylene foam or thermoplastic polymer-based material.

In another embodiment, the present invention is comprised of a multi-section, one-piece garment for protecting against impact upon a human torso when worn by an athlete during sporting activities. The multi-section, one-piece garment, which is donned and removed in an over-the-hand, pullover manner, comprises of a vest sized and shaped to be worn on a torso of an athlete including an anterior portion, a posterior portion, a pair of lateral portions and a shoulder portion, the vest having a multi-layered padding in the anterior portion, the posterior portion, and the pair of lateral portions to protect the torso of the athlete engaged in a sporting activity, the shoulder portion of the vest being comprised primarily, if not totally of material that provides for the cooling of the underlying torso. Excellent results are obtained when the material that provides for the cooling of the underlying torso is comprised of either a mesh-type material or a cooling fabric such as HYDROWEAVE®.

In another embodiment, the present invention is comprised of a multi-section, one-piece garment 18 for protecting against impact upon a human torso when worn by an athlete during sporting activities. The multi-section, one-piece garment 18 comprises of a vest 20 sized and shaped to be worn on a torso by an athlete including an anterior portion 24, a posterior portion 28, a pair of lateral portions 26, a shoulder portion 22 and an offset opening 42 as shown in FIG. 4 and 8, the vest 20 having a multi-layered padding in the anterior portion 24, the shoulder portion 22 and the posterior portion 28 to protect the torso of the athlete engaged in a sporting activity, the pair of lateral portions 26 of the vest being comprised primarily, if not totally of material 40 that provides for the cooling of the underlying torso, as shown in FIG. 4. Excellent results are obtained when the material 40 that provides for the cooling of the underlying torso is comprised of either a mesh-type material or a cooling fabric such as HYDROWEAVE®.

As shown in FIGS. 4 and 8, the shoulder portion 22 has the multi-layered padding sized and shaped to provide protection to the shoulder area and unhindered movement of the arms and neck. The shoulder portion 22 further contains a pair of oversized apertures 30, leaving the shoulder area in an unhindered condition and allowing full movement of the arms. An alternative version of this embodiment of the vest has the shoulder portion 22, in addition to the pair of lateral portions 26, being comprised primarily, if not totally of material that provides for the cooling of the underlying torso.

As shown in FIG. 8, the anterior portion 24 has the multi-layered padding sized and shaped to allow unhindered movement of the legs and provide protection against impact to the chest, heart spleen and abdomen. The anterior portion 24 further has a slot or opening 34 on the interior or exterior surface or the first layer or the third layer of the multi-layered padding allowing for the removal or insertion of the second layer of the multi-layered padding, or a layer or layers thereof, from the vest 20.

As shown in FIG. 4, the posterior portion 28 further protects the torso by having the multi-layered padding sized and shaped to provide protection from impact to the back. In order to provide both protection to the lower spine area and unhindered movement of the legs, the posterior portion 28 is shaped in a tapered design 32 in the inferior-most region.

As shown in FIG. 8, in order to secure the vest 20 around the torso, a fastening device 44 is attached about the offset opening 42 to engage the vest 20 when fastened to secure the vest on the torso. Excellent results are obtained when the fastening device 44 is comprised of a zipper mechanism as shown in FIG. 8. As is common practice, a strip or strips of material or padding are affixed to the vest under the zipper, effectively providing a protective barrier between the zipper and the underlying clothing/torso. This protective barrier eliminates possible "catches" of the clothing/torso, which would interfere with the operation of the zipper, protects the underlying torso from being cut or otherwise injured by the zipper and provides protection to the underlying torso from impact in the area of the zipper. Excellent results are obtained when the strip or strips of material or padding are comprised of elastic fabric-covered Neoprene padding. As is additionally a common practice, a strip or strips of material or padding are affixed to the vest over the zipper, effectively providing a protective barrier over the zipper. This protective barrier eliminates possible "catches" of the zipper and provides further protection to the underlying torso from impact in the area of the zipper. Excellent results are obtained when the strip or strips material or padding are comprised of elastic fabric-covered Neoprene padding. As is further common practice, a zipper pull-tab cover may be affixed to the vest to secure the zipper pull-tab in the down position when the zipper is fastened. Excellent results are obtained when the zipper pull tab cover is comprised of a small strap which is fastened across the zipper pull tab with VELCRO when the zipper is fastened, securing the zipper pull tab in the down position.

As is also shown in FIG. 8, the present invention further has at least one protective pad 36 comprising rigid, semi-rigid or flexible material inserted into a pocket 38 on, the interior or exterior surface of the first, or outer layer of the multi-layered padding, or affixed onto the exterior surface of the second, or middle layer of the multi-layered padding, in the superior region of the anterior portion 24 and sized and shaped to provide protection from impact to the heart. Excellent results are obtained when the protective pad 36 is comprised of polyethylene foam or thermoplastic polymer-based material.

In another embodiment, the present invention is comprised of a multi-section, one-piece garment 19 for protecting against impact upon a human torso when worn by an athlete during sporting activities. The multi-section, one-piece garment 19 comprises of a vest 21 sized and shaped to be worn on a torso by an athlete including an anterior portion 24, a posterior portion 28, a pair of lateral portions 26, a shoulder portion 22 and an offset opening 42 as shown in FIGS. 5 and 8, the vest 21 having a multi-layered padding in the anterior portion 24 and the shoulder portion 22 to protect the torso of the athlete engaged in a sporting activity, the posterior portion 28 and pair of lateral portions 26 of the vest being comprised primarily, if not totally of material 40 that provides for the cooling of the underlying torso, as shown in FIG. 5. Excellent results are obtained when the material 40 that provides for the cooling of the underlying torso is comprised of either a mesh-type material or a cooling fabric such as HYDROWEAVE®.

As shown in FIGS. 5 and 8, the shoulder portion 22 has the multi-layered padding sized and shaped to provide protection to the shoulder area and unhindered movement of the arms and neck. The shoulder portion 22 further contains a pair of oversized apertures 30, leaving the shoulder area in an unhindered condition and allowing full movement of the arms. An alternative version of this embodiment of the vest has the shoulder portion 22, in addition to the posterior portion 28 and the pair of lateral portions 26, being comprised primarily, if not totally of material that provides for the cooling of the underlying torso.

As shown in FIG. 8, the anterior portion 24 has the multi-layered padding sized and shaped to allow unhindered movement of the legs and provide protection against impact to the chest, heart spleen and abdomen. The anterior portion 24 further has a slot or opening 34 on the interior or exterior surface or the first layer or the third layer of the multi-layered padding allowing for the removal or insertion of the second layer of the multi-layered padding, or a layer or layers thereof, from the vest 21.

As shown in FIG. 8, in order to secure the vest 21 around the torso, a fastening device 44 is attached about the offset opening 42 to engage the vest 21 when fastened to secure the vest on the turso. Excellent results are obtained when the fastening device 44 is comprised of a zipper mechanism as shown in FIG. 8. As is common practice, a strip or strips of material or padding are affixed to the vest under the zipper, effectively providing a protective barrier between the zipper and the underlying clothing/torso. This protective barrier eliminates possible "catches" of the clothing/torso, which would interfere with the operation of the zipper, protects the underlying torso from being cut or otherwise injured by the zipper and provides protection to the underlying torso from impact in the area of the zipper. Excellent results are obtained when the strip or strips of material or padding are comprised of elastic fabric-covered Neoprene padding. As is additionally a common practice, a strip or strips of material or padding are affixed to the vest over the zipper, effectively providing a protective barrier over the zipper. This protective barrier eliminates possible "catches" of the zipper and provides further protection to the underlying torso from impact in the area of the zipper. Excellent results are obtained when the strip or strips material or padding are comprised of elastic fabric-covered Neoprene padding. As is further common practice, a zipper pull-tab cover may be affixed to the vest to secure the zipper pull-tab in the down position when the zipper is fastened. Excellent results are obtained when the zipper pull tab cover is comprised of a small strap which is fastened across the zipper pull tab with VELCRO when the zipper is fastened, securing the zipper pull tab in the down position.

As is also shown in FIG. 8, the present invention further has at least one protective pad 36 comprising rigid, semi-rigid or flexible material inserted into a pocket 38 on, the interior or exterior surface of the first, or outer layer of the multi-layered padding, or affixed onto the exterior surface of the second, or middle layer of the multi-layered padding, in the superior region of the anterior portion 24 and sized and shaped to provide protection from impact to the heart. Excellent results are obtained when the protective pad 36 is comprised of polyethylene foam or thermoplastic polymer-based material.

Figure 6:
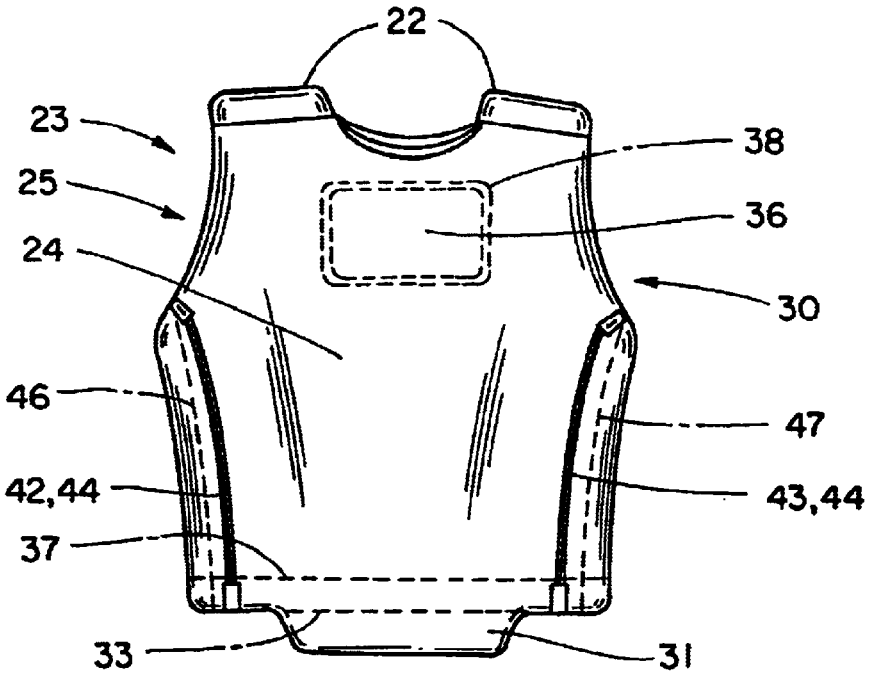
FIG. 6 is a front view of the preferred embodiment of the offset-opening/offset openings version of the vest that incorporates two offset openings.
Figure 7:
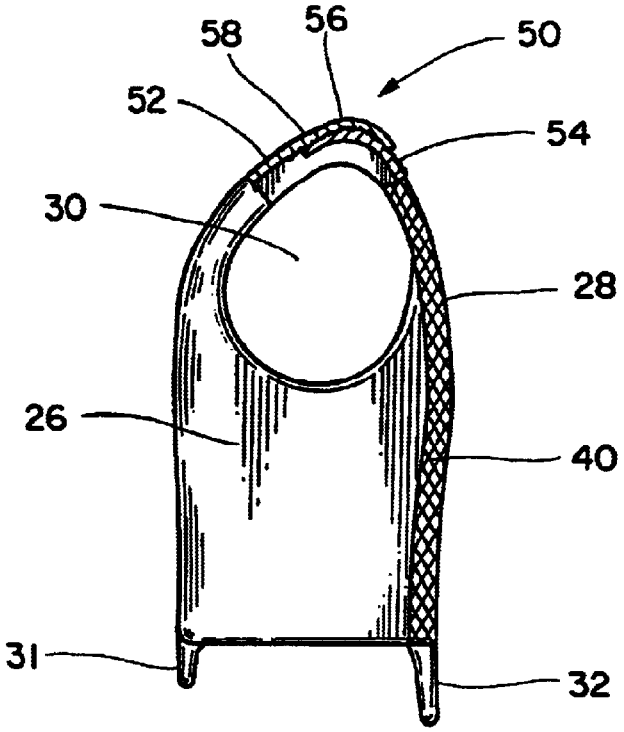
FIG. 7 is a side view of the preferred embodiment of the offset-opening/offset openings version of the vest that incorporates overlaps in the shoulder area to provide for an adjustment to the vest length.

In another embodiment, the present invention is comprised of a multi-section, one-piece garment 23 for protecting against impact upon a human torso when worn by an athlete during sporting activities. The multi-section, one-piece garment 23 comprises of a vest 25 sized and shaped to be worn on a torso by an athlete including an anterior portion 24, a posterior portion 28, a pair of lateral portions 26, a shoulder portion 22 and two offset openings 46,47 as shown in FIGS. 6 and 7, the vest 25 having a multi-layered padding in the anterior portion 24, the shoulder portion 22 and the pair of lateral portions 26 to protect the torso of the athlete engaged in a sporting activity, the posterior portion 28 of the vest being comprised primarily, if not totally of material 40 that provides for the cooling of the underlying torso, as shown in FIG. 7. Excellent results are obtained when the material 40 that provides for the cooling of the underlying torso is comprised of either a mesh-type material or a cooling fabric such as HYDROWEAVE®.

A version of this embodiment of the vest with only one offset opening would, 1) except for the second offset opening 47 and the second fastening device 44 depicted, be identical to the version of the vest with two offset openings depicted in FIG. 6 and, 2) except for the pair of lateral portions 26 being comprised of material 40 that provides for the cooling of the underlying torso as depicted in FIG. 8, be identical to the version of the vest with one offset open depicted in FIG. 8.

The exact location of the offset opening can vary to a degree. Whether or not an overlap or flap is utilized, locating the offset opening to close to the medial line of the human torso would defeat the main purpose of the offset opening: protecting the heart from impact. For those embodiments of the vest not utilizing an overlap or flap, locating the offset opening or offset openings too far onto the side of the human torso would make the fastening of the fastening device 44 cumbersome. Depending on the location of the offset opening, the anterior portion and the shoulder portion may be one continuous piece, wherein the vest is donned/removed over the head.

As shown in FIGS. 6 and 7, the shoulder portion 22 has the multi-layered padding sized and shaped to provide protection to the shoulder area and unhindered movement of the arms and neck. The shoulder portion 22 further contains a pair of oversized apertures 30, leaving the shoulder area in an unhindered condition and allowing full movement of the arms. An alternative version of this embodiment of the vest has the shoulder portion 22, in addition to the posterior portion 28, being comprised primarily, if not totally of material that provides for the cooling of the underlying torso.

As shown in FIG. 7, the shoulder portion 22 further has the right section 48 and the left section 50 of the shoulder portion 22 being comprised of an anterior section 52 and a posterior section 54, the respective anterior section 52 and posterior section 54 of the right shoulder section 48 and the left shoulder section 50 overlapping, the overlap 56 being secured by a fastening device 58 to hold the respective anterior and posterior sections 52,54 of the right shoulder section 48 and left shoulder sections 50 together, the overlap 56 being adjustable to provide for a change in the vest length. Excellent results are obtained when the fastening device 58 is comprised of VELCRO.

As shown in FIGS. 6 and 7, the anterior portion 24 has the multi-layered padding sized and shaped to allow unhindered movement of the legs and provide protection against impact to the chest, heart spleen and abdomen. The anterior portion 24 is further overlapped by the pair of lateral portions 26, as shown by the dotted lines in FIG. 6 that depict the underlying offset opening 46,47 or the edges of the anterior portion 24.

As shown in FIG. 6 and 7, the anterior portion 24 is further shaped in a tapered design 31 in the inferior-most region to protect the lower abdomen and allow unhindered movement of the legs. As depicted in FIG. 6 by the dotted line 33, the tapered section 31 of the anterior portion 24 is removable from the vest, being fastened to the vest by a fastening device (hidden from view). Excellent results are obtained when the fastening device is comprised of VELCRO. An alternative version of this embodiment of the vest has the shoulder portion 22 being comprised of either 1) an anterior section, a posterior section and a middle section, the respective anterior and posterior sections of the right and left shoulder sections overlapping or interlocking with the middle section, the overlap or interlock being secured by a fastening device or devices to hold the respective anterior, posterior and middle sections of the right and left shoulder sections together, the overlap or interlock being adjustable to provide for a change in the vest length or 2) an anterior section, a posterior section and a middle section, the respective anterior and posterior sections of the right and left shoulder sections overlapping or interlocking with the middle section, the respective anterior and posterior sections of the right and left shoulder sections being capable of overlapping or interlocking with each other, the overlap of overlaps or interlock or interlocks being secured by a fastening device or devices to hold the respective anterior, posterior and middle sections of the right and left shoulder sections together, the overlap or overlaps or interlock or interlocks being adjustable to provide for a change in the vest length.

As shown in FIGS. 6 and 7, the pair of lateral portions 26 further protects the torso by having the multi-layered padding sized, shaped and constructed to provide protection from impact to the lateral regions and unhindered movement of the legs. The pair of lateral portions 26 further overlap 42, 43 the anterior portion 24, as shown by the dotted lines in FIG. 6 that depict the underlying offset openings 46,47 or the edges of the anterior portion 24.

While the starting portion of the overlap 42,43 depends on the location of the offset opening 46,47 both the direction and extent of the overlap 46,47 can vary. Assuming a side-to-front overlap, extending the edge of the overlap to close to the medial line of the human torso would place the fastening device in the area of the heart. Although with the overlap the fastening device essentially sits on top of the vest, eliminating any gap in the protective padding that may result within an overlap isn't utilized, and thus is not in direct contact with the underlying torso, locating the edge of the overlap so close to the medial line of the human torso that the fastening device is located in the area of the heart is not preferable. Conversely, assuming a front-to-side overlap, extending the overlap too far onto the side of the human torso would make the donning/removal of the vest, including the fastening/unfastening of the fastening device, cumbersome.

Given that the overlapped parts of the vest are hidden from view, a version of this embodiment of the vest without one or both of the overlaps would appear virtually identical to the version of the vest depicted in FIG. 7. In this alternative version of the vest without one or both of the overlaps, a fastening device 44 would be fastened across the offset opening to secure the vest on the torso, the offset opening and the vertical path of the fastening device 44 essentially being one in the same, or congruent.

A version of this embodiment of the vest substituting a flap or flaps in place of an overlap or the overlaps 42,43 would appear similar to the version of vest depicted in FIG. 7, except for the addition of the flap or flaps covering the area or areas of the offset opening or offset openings and the fastening device 44. In this alternative version of the vest without one or both of the overlaps, a fastening device 44 would be fastened across the offset opening to secure the vest on the torso, the offset opening and the vertical length, or path of the fastening device 44 essentially being one in the same, or congruent. The flap, being attached to the vest on one side of the offset opening, would be fastened across the offset opening onto the other side of the vest by a fastening device or devices, covering the area of the offset opening and the fastening device 44.

As shown in FIG. 7, the posterior portion 28 is shaped in a tapered design 32 in the inferior-most region to provide protection to the lower spine area and allow unhindered movement of the legs, the taper 32 being comprised of a padding material or a multi-layer padding wherein the inner and outer layer of layers sandwich, or provide a shell for the middle layer or layers.

As shown in FIG. 6, in order to secure the vest 25 around the torso, a fastening device 44 is attached about the overlaps 42,43 to engage the vest 25 when fastened to secure the vest on the torso. Excellent results are obtained which the fastening device 44 is comprised of a zipper mechanism as shown in FIG. 6. As is common practice, a strip or strips of material or padding are affixed to the vest under the zipper, effectively providing a protective barrier between the zipper and the underlying clothing/torso. This protective barrier eliminates possible "catches" of the clothing/torso, which would interfere with the operation of the zipper, protects the underlying torso from being cut or otherwise injured by the zipper and provides protection to the underlying torso from impact in the area of the zipper. Excellent results are obtained when the strip or strips of material or padding are comprised of elastic fabric-covered Neoprene padding. As is additionally a common practice, a strip or strips of material or padding are affixed to the vest over the zipper, effectively providing a protective barrier over the zipper. This protective barrier eliminates possible "catches" of the zipper and provides further protection to the underlying torso from impact in the area of the zipper. Excellent results are obtained when the strip or strips material or padding are comprised of elastic fabric-covered Neoprene padding. As is further common practice, a zipper pull-tab cover may be affixed to the vest to secure the zipper pull-tab in the down position when the zipper is fastened. Excellent results are obtained when the zipper pull tab cover is comprised of a small strap which is fastened across the zipper pull tab with VELCRO when the zipper is fastened, securing the zipper pull tab in the down position.

As is also shown in FIG. 6, the present invention further has at least one protective pad 36 comprising rigid, semi-rigid or flexible material inserted into a pocket 38 on, the interior or exterior surface of the first, or outer layer of the multi-layered padding, or affixed onto the exterior surface of the second, or middle layer of the multi-layered padding, in the superior region of the anterior portion 24 and sized and shaped to provide protection from impact to the heart. Excellent results are obtained when the protective pad 36 is comprised of polyethylene foam or thermoplastic polymer-based material.

In another embodiment, the present invention is comprised of a multi-section, one-piece garment for protecting against impact upon a human torso when worn by an athlete during sporting activities. The multi-section, one-piece garment comprises of a vest sized and shaped to be worn on a torso by an athlete including an anterior portion, a posterior portion, a pair of lateral portions, a shoulder portion and an offset opening, the vest having a multi-layered padding in the anterior portion, the posterior portion and the pair of lateral portions to protect the torso of the athlete engaged in a sporting activity, the shoulder portion of the vest being comprised primarily, if not totally of material that provides for the cooling of the underlying torso. Excellent results are obtained when the material that provides for the cooling of the underlying torso is comprised of either a mesh-type material or a cooling fabric such as HYDROWEAVE®.

In another embodiment, the present invention is comprised of a multi-section, one-piece garment 9 for protecting against impact upon a human torso when worn by an athlete during sporting activities. The multi-section, one-piece garment 9 comprises of a vest 11 sized and shaped to be worn on a torso by an athlete having a multi-layered padding to protect the torso of the athlete, including an anterior portion 24, a posterior portion 28, a pair of lateral portions 26, a shoulder portion 22 and either an offset opening 46 or offset openings 46,47 as shown in FIGS. 2 and 6.

A version of this embodiment of the vest with only one offset opening would, 1) except for the second offset opening 47 and the second fastening device 44 depicted, be identical to the version of the vest with two offset openings depicted in FIG. 6 and, 2) except for the pair of lateral portions 26 being comprised of material 40 that provides for the cooling of the underlying torso as depicted in FIG. 8, be identical to the version of the vest with one offset opening depicted in FIG. 8.

The exact location of the offset opening can vary to a degree. Whether or not an overlap or flap is utilized, locating the offset opening to close to the medial line of the human torso would defeat the main purpose of the offset opening: protecting the heart from impact. For those embodiments of the vest not utilizing an overlap or flap, locating the offset opening or offset openings too far onto the side of the human torso would make the fastening of the fastening device 44 cumbersome. Depending on the location of the offset opening, the anterior portion and the shoulder portion may be one continuous piece, wherein the vest is donned/removed over the head.

As shown in FIGS. 2 and 6, the shoulder portion 22 has the multi-layered padding sized and shaped to provide protection to the shoulder area and unhindered movement of the arms and neck. The shoulder portion 22 further contains a pair of oversized apertures 30, leaving the shoulder area in an unhindered condition and allowing full movement of the arms.

As shown in FIGS. 6, the anterior portion 24 has the multi-layer padding sized and shaped to allow unhindered movement of the legs and provide protection against impact to the chest, heart spleen and abdomen. The anterior portion 24 is further overlapped by the pair of lateral portions 26, as shown by the dotted lines in FIG. 6 that depict the underlying offset openings 46,47 or the edges of the anterior portion 24.

As shown in FIG. 6, the anterior portion 24 is further shaped in a tapered design 31 in the inferior-most region to protect the lower abdomen and allow unhindered movement of the legs. As depicted in FIG. 6 by the dotted line 33, the tapered section 31 of the anterior portion 24 is removable from the vest, being fastened to the vest by a fastening device (hidden from view). Excellent results are obtained when the fastening device is comprised of VELCRO.

As shown in FIGS. 2 and 6, the pair of lateral portions 26 further protects the torso by having the multi-layered padding sized, shaped and constructed to provide protection from impact to the lateral regions and unhindered movement of the legs. The pair of lateral portions 26 further overlap 42,43 the anterior portion 24, as shown by the dotted lines in FIG. 6 that depict the underlying offset openings 46,47 or the edges of the anterior portion 24.

While the staring point of the overlap 42,43 depends on the location of the offset opening 46,47 both the direction and extend of the overlap 42,43 can vary. Assuming a side-to-front overlap, extending the edge of the overlap to close to the medial line of the human torso would place in fastening device in the area of the heart. Although with the overlap the fastening device essentially sits on top of the vest, eliminating any gap in the protective padding that may result when an overlap isn't utilized, and thus is not in direct contact with the underlying torso, locating the edge of the overlap so close to the medial line of the human torso that the fastening device is located in the area of the heart is not preferable. Conversely, assuming a front-to-side overlap, extending the overlap too far onto the side of the human torso would make the donning/removal of the vest, including the fastening/unfastening of the fastening device, cumbersome.

Given that the overlapped parts of the vest are hidden from view, a version of this embodiment of the vest without one or both of the overlaps would appear virtually identical to the version of the vest depicted in FIG. 7. In this alternative version of the vest without one or both of the overlaps, a fastening device 44 would be fastened across the offset opening to secure the vest on the torso, the offset opening and the vertical path of the fastening device 44 essentially being one in the same, or congruent.

A version of this embodiment of the vest substituting a flap or flaps in place of an overlap or the overlaps 42,43 would appear similar to the version of vest depicted in FIG. 7, except for the addition of the flap or flaps covering the area or areas of the offset opening or offset openings and the fastening device 44. In this alternative version of the vest without one or both of the overlaps, a fastening device 44 would be fastened across the offset opening to secure the vest on the torso, the offset opening and the vertical length, or path of the fastening device 44 essentially being one in the same, or congruent. The flap, being attached to the vest on one side of the offset opening, would be fastened across the offset opening onto the other side of the vest by a fastening device or devices, covering the area of the offset opening and the fastening device 44.

As shown in FIG. 2, the posterior portion 28 further protects the torso by having the multi-layered padding size and shaped to provide protection from impact to the back. In order to provide both protection to the lower spine area and unhindered movement of the legs, the posterior portion 28 is shaped in a tapered design 32 in the inferior-most region. As depicted in FIG. 2 by the dotted line 35, the bottom part of the tapered section 32 of the posterior portion 28 is removable from the vest, being fastened to the vest by a fastening device (hidden from view). Excellent results are obtained when the fastening device is comprised of VELCRO.

As shown in FIG. 2, in order to enable the athlete to customize the protective padding for safety, comfort or athletic performance purposes, the posterior portion 28 further contains a slot or opening 34 on the interior or exterior surface or the first layer or the third layer of the multi-layered padding allowing for the removal or insertion of the second layer, or a layer or layers thereof, from the vest 11.

As shown in FIG. 7, in order to secure the vest 25 around the torso, a fastening device 44 is attached about the overlaps 42,43 to engage the vest 25 when fastened to secure the vest on the torso. Excellent results are obtained when the fastening device 44 is comprised of a zipper mechanism as shown in FIG. 7.

As is also shown in FIG. 7, the present invention further has at least one protective pad 36 comprising rigid, semi-rigid or flexible material inserted into a pocket 38 on, the interior or exterior surface of the first, or outer layer of the multi-layered padding, or affixed onto the exterior surface of the second, or middle layer of the multi-layered padding, in the superior region of the anterior portion 24 and sized and shaped to provide protection from impact to the heart. Excellent results are obtained when the protective pad 36 is comprised of polyethylene foam or thermoplastic polymer-based material.

In an alternative version of any of the above embodiments of the vest, the posterior portion comprises at least one posterior portion faster and/or the anterior portion comprises at least one anterior portion fastener, the posterior portion fastener and the anterior portion fastener being connected by a strap, the strap thus securing the posterior portion to the anterior portion.

Each of the embodiments of the invention described above can utilize a cooling fabric such a HYDROWEAVE® in either the third, or inner layer of the multi-layer padding or in those portions of the vest that are specified in the claims are being comprised primarily, if not totally of material that provides for the cooling of the underlying torso. In either case, as specified in the claims, the cooling fabric may be removable from the vest to facilitate the cooling of the fabric prior to use, being attached to the vest by a fastening device or devices. Excellent results are obtained when the fastening device is comprised of a VELCRO-type fastener, snap fasteners, button fasteners or a zipper fastener.

Each of the embodiments of the invention described above can, with the following slight modifications, be worn by a mature female athlete: incorporating a convex configuration in the superior region of the anterior portion, and in the superior region of the flap/flaps and/or overlap/overlaps for those embodiments that include the flap/flaps and/or overlap/overlaps, for receiving the female breasts and incorporating a concave configuration in the inferior-most regions of the pair of lateral portions for receiving the female hips.

As various possible embodiments may be made in the above invention for use for different purposes and as various changes might be made in the embodiments and methods above set forth, and as the details concerning certain common practices may not have been included, it is understood that all the above matters here set forth or shown in the accompanying drawings are to be interpreted as illustrative and not in a limiting sense.

What is claimed is:

1. A multi-section, one-piece garment for protecting against impact upon a human torso when worn by an athlete during sporting activities, the multi-section, one-piece garment comprising:

a vest sized and shaped to be worn on a torso of an athlete, the vest being donned and removed in an over-the-head, pullover manner, the vest having a multi-layered padding to protect the torso of the athlete including a chest, an abdomen, a pair of lateral regions, a shoulder area and a back, the vest further comprising a shoulder portion, an anterior portion, a pair of lateral portions and a posterior portion, the multi-layered padding having three layers, wherein the first, or outer layer and the third, or inner layer of the multi-layered padding sandwich, or are joined at a seam to provide a shell for, the second, or middle layer, the second layer being formed from a padding material for protecting against impact to the torso, the shoulder portion having a pair of oversized apertures located at the lateral most regions for receiving the arms, each oversized aperture being sized and shaped to permit full movement of the arm.

2. The multi-section, one-piece garment of claim 1, wherein the anterior portion and pair of lateral portions have the multi-layered padding sized and shaped to allow unhindered movement of the legs and protect the chest, heart, spleen, abdomen and lateral regions against impact.

3. The multi-section, one-piece garment of claim 2, wherein the pair of lateral portions have the multi-layered padding, or a layers thereof, being comprised of elastic material.

4. The multi-section, one-piece garment of claim 1, wherein the lateral most edges of the second layer of the multi-layered padding in the anterior portion and/or posterior portion of the vest, or a layer thereof, extend over and/or overlap in the pair of lateral portions of the vest for the purpose of a second layer of the multi-layered padding between the first and third layers in the pair of lateral portions of the vest as the vest stretches horizontally to accommodate larger torso sizes.

5. The multi-section, one-piece garment of claim 1, wherein the shoulder portion has the multi-layered padding sized and shaped to provide protection to the shoulder area and permit unhindered movement of the arms and neck.

6. The multi-section, one-piece garment of claim 5, wherein the shoulder portion having the multi-layered padding, or a layer or layers thereof, being comprised of elastic material.

7. The multi-section, one-piece garment of claim 1, wherein the posterior portion has the multi-layered padding sized and shaped to protect the back against impact.

8. The multi-section, one-piece garment of claim 1, wherein the second layer of the multi-layered passing material being formed from polymeric cellular foam to protect the torso against impact.

9. The multi-section, one-piece garment of claim 1, wherein at least one single or multi-part adjustable securing belt-like device such as a belt, strap or drawstring is wrapped around the multi-layered padding, or partially thereof, on the first, or outer layer, the second, or middle layer, or a layer thereof, or the first and second layer alternately, of the vest to secure the vest about the torso, the adjustable securing belt-like device being fastened to the vest by a fastening means and/or inserted through a vertical loop or loops and/or a slot or slots and/or an opening or openings, the vertical loop or loops being attached to the vest and the slot or slots and/or opening or openings being located in the first, or outer layer and/or the third, or inner layer of the vest to hold the adjustable securing belt-like device around the torso, the adjustable securing belt-like device being fastened by a belt-like device fastener or fasteners.

10. The multi-section, one-piece garment of claim 1, wherein the superior region of the anterior portion is shaped in a convex configuration, the convex configuration providing space for receiving breasts.

11. The multi-section, one-piece garment of claim 1, wherein the inferior-most regions of the pair of lateral portions are shaped in a concave configuration, the concave configuration providing space for receiving the hip.

12. The multi-section, one-piece garment of claim 1, wherein the posterior portion contains at least one fastener or holder for securing a removable strip of fabric or flag.

13. The multi-section, one-piece garment of claim 1, wherein at least one slot or opening located on the interior or exterior surface of the first or third layer of the multi-layered padding, or in the seam where the first and third layers are joined to form the shell, which may or may not have a fastening device or devices to secure it in a closed position, allows for the removal or insertion of the second layer of the multi-layered padding, or a layer on layers, or a portion or portions, or a section or sections thereof, from the vest.

14. The multi-section, one-piece garment of claim 1, wherein the multi-layered padding, or a portion or portions and/or a layer or layers and/or a section or sections thereof, being comprised of air-permeable and/or moisture-control/wicking material to allow for the cooling of the underlying torso.

15. The multi-section, one-piece garment of claim 1, wherein the multi-layered padding, or a layer or layers thereof, is punctuated with a plurality of air holes to provide for the cooling of the underlying torso.

16. The multi-section, one-piece garment of claim 1, wherein a protective pad or pads comprising rigid, semi-rigid or flexible material are affixed onto, and/or inserted into a pocket on, the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, of the of the anterior portion and sized and shaped to provide protection from impact to the heart and/or spleen, the protective pad or pads being removable and insertable by the wearer; with access to the interior of the shell provided via either the slot or opening that allows for the removal or insertion of the second, or middle layer of the multi-layer padding from the vest, or a separate slot or located opening on the interior or exterior surface of the shell, or in the seam where the first and third layers of the multi-layer padding are joined to form the shell, which may or may not be secured in a closed position by a fastening device or devices.

17. The multi-section, one-piece garment of claim 1, wherein the first layer and/or second layer and/or third layer of multi-layered padding, or portions or sections thereof, are comprised of a multiple layers.

18. The multi-section, one-piece garment of claim 7, wherein the interior-most region of the posterior portion is shaped in either a short taper to protect the back and allow the unhindered movement of the legs, or a long taper to provide protection to the lower spine area and allow unhindered movement of the legs.

19. The multi-section, one-piece garment of claim 1, wherein the posterior portion comprises at least one posterior portion fastener and/or the anterior portion comprises at least one anterior portion fastener, the posterior portion fastener and the anterior portion fastener being connected by a strap, the strap thus securing the posterior portion to the anterior portion.

20. The multi-section, one-piece garment of claim 5, wherein the shoulder portion, or a section or sections thereof, has the multi-layered padding consisting of only the outer layer and the inner layer to permit unhindered movement of the arms and neck.

21. The multi-section, one-piece garment of claim 2, wherein the lateral portions, or a section or sections thereof, has the multi-layered padding consisting of only the outer layer and the inner layer to permit unhindered movement of the legs and torso and provide for the cooling of the underlying torso.

22. The multi-section, one-piece garment of claim 2, wherein the inferior-most region of the anterior portion is shaped in either a short taper to protect the lower abdomen and allow unhindered movement of the legs, or a long taper to protect the lower abdomen and allow unhindered movement of the legs.

23. The multi-section, one-piece garment of claim 1, wherein the multi-layer padding in a portion or portions of the vest consists of only the first and third or outer and inner layers at or over openings, seams, breaks, slits, cuts or cut outs in the second, or middle layer or the multi-layer padding.

24. The multi-section, one-piece garment of claim 1, wherein the second, or middle layer, or a layer or layers thereof, a) in the left and/or right lateral portions, or a portion thereof, and the anterior portion, or a portion thereof, overlap and/or are interlocked and/or are connected and/or are comprised of one continuous piece, b) and/or in the left and/or right lateral portions, or a portion thereof, and the back portion, or a portion thereof, overlap, and/or are interlocked and/or are connected and/or are comprised of one continuous piece, c) and/or are comprised of one continuous piece, d) and/or are comprised of two pieces which meet in the back portion and overlap and/or are interlocked and/or are connected, e) and/or is comprised of multiple pieces which overlap and/or are interlocked and/or are connected.

25. The multi-section, one-piece garment of claim 1, wherein the third, or inner layer of the multi-layer padding, or a layer or layers, or a portion or portions, or a sections or sections thereof, is removable, being fastened to the vest by a fastening device or devices.

26. The multi-section, one-piece garment of claim 18, wherein the tapered section, or the bottom part thereof, in the inferior-most region of the posterior portion is removable from the vest, being fastened by a fastening device or devices.

27. The multi-section, one-piece garment of claim 22, wherein the tapered section, or the bottom part thereof, in the inferior-most region of the anterior portion is removable from the vest, being fastened to the vest by a fastening device or devices.

28. The multi-section, one-piece garment of claim 1, wherein an inferior section and a superior section of the anterior portion and/or the lateral portions and/or the posterior portion overlap, are interlocked or abutted, the overlap, interlock or abutment being secured by a fastening device or devices to attach the inferior section and the superior section together, the fastening device or devices allowing for the removal of the inferior section to change the vest length and/or the overlap, interlock or abutment, and the related fastening device or devices securing the overlap, interlock or abutment, being adjustable to change the vest length.

29. The multi-section, one-piece garment of claim 1, wherein a right section and a left section of the shoulder portion each comprise an anterior section and a posterior section, the respective anterior and posterior sections of the right and left shoulder sections overlapping or interlocking, the overlap or interlock being secured by a fastening device or devices to hold the respective anterior and posterior sections of the right and left shoulder sections together, the overlap or interlock being adjustable to provide for a change in the vest length.

30. The multi-section, one-piece garment of claim 1, wherein a right section and a left section of the shoulder portion each comprise an anterior section, a posterior section and a middle section, the respective anterior and posterior sections of the right and left shoulder sections overlapping or interlocking with the middle section, the overlap or interlock being secured by a fastening device or devices to hold the respective anterior, posterior and middle sections of the right and left shoulder sections together, the overlap or interlock being adjustable to provide for a change in the vest length.

31. The multi-section, one-piece garment of claim 1, wherein a right section and a left section of the shoulder portion each comprise an anterior section, a posterior section and a middle section, the respective anterior and posterior sections of the right and left shoulder sections overlapping or interlocking with the middle section, the respective anterior and posterior sections of the right and left shoulder sections being capable of overlapping or interlocking with each other, the overlap or overlaps or interlock or interlocks being secured by a fastening device or devices to hold the respective anterior, posterior and middle sections of the right and left shoulder sections together, the overlap or overlaps or interlock or interlocks being adjustable to provide for a change in the vest length.

32. A multi-section, one-piece garment for protecting against impact upon a human torso when worn by an athlete during sporting activities, the multi-section, one-piece garment comprising:

a vest sized and shaped to be worn on a torso of an athlete, the vest being donned and removed in an over-the-head, pullover manner, the vest comprising an anterior portion, a posterior portion, a pair of lateral portions and a shoulder portion, the best having a multi-layered padding in the anterior portion and the shoulder portion and/or the lateral portions and/or the posterior portion of the vest to protect the torso of the athlete, the multi-layered padding having three layers, wherein the first, or outer layer and the third, or inner layer of the multi-layered padding sandwich, or are joined at a seam to provide a shell for, the second, or middle layer, the second layer being formed from a padding material for protecting against impact to the torso, the posterior portion and/or the lateral portions and/or the shoulder portion of the best being comprised primarily, if not totally of material that provides for the cooling of the underlying torso.

33. The multi-section, one-piece garment of claim 32, wherein the shoulder portion having the multi-layered padding sized and shaped to provide protection to the shoulder area and permit unhindered movement of the arms and neck, the shoulder portion further having a pair of oversized apertures located at the lateral most regions for receiving the arms, each oversized aperture being sized and shaped to permit full movement of the arm.

34. The multi-section, one-piece garment of claim 32, wherein the shoulder portion having the multi-layered padding, or a layer or layers thereof, being comprised of elastic material.

35. The multi-section, one-piece garment of claim 32, wherein the anterior portion has the multi-layered padding sized and shaped to allow unhindered movement of the legs and to protect against impact to the chest, heart, spleen and abdomen.

36. The multi-section, one-piece garment of claim 32, wherein the posterior portion has the multi-layered padding sized and shaped to protect the back against impact.

37. The multi-section, one-piece garment of claim 36, wherein the inferior-most region of the posterior portion is shaped in either a short taper to protect the back and allow the unhindered movement of the legs, or a long taper to provide protection to the lower spine area and allow unhindered movement of the legs.

38. The multi-section, one-piece garment of claim 32, wherein the posterior portion is comprised primarily, if not totally of material that provides for the cooling of the underlying torso.

39. The multi-section, one-piece garment of claim 38, wherein the posterior portion has a tapered section in the inferior-most region, the tapered being comprised of a padding material or a multi-layer padding wherein the inner and outer layer or layers sandwich or provide a shell for the middle layer or layers to provide protection to the lower spine area.

40. The multi-section, one-piece garment of claim 32, wherein the pair of the lateral portions has the multi-layered padding sized and shaped to allow unhindered movement of the legs and to protect against impact to the lateral regions.

41. The multi-section, one-piece garment of claim 32, wherein the pair of lateral portions are comprised primarily, if not totally of material that provides for the cooling of the underlying torso.

42. The multi-section, one-piece garment of claim 32, wherein at least one single or multi-part adjustable securing belt-like device such as a belt, strap or drawstring is wrapped around the multi-layered padding, or partially thereof, on the first, or outer layer, the second, or middle layer, or a layer thereof, or the first and second layer alternately, of the vest to secure the vest about the torso, the adjustable securing belt-like device being fastened to the vest by a fastening means and/or inserted through a vertical loop or loops and/or a slot or slots and/or an opening or openings, the vertical loop or loops being attached to the vest and the slot or slots and/or opening or openings being located in the first, or outer layer and/or the third, or inner layer of the vest to hold the adjustable securing belt-like device around the torso, the adjustable securing belt-like device being fastened by a belt-like device fastener or fasteners.

43. The multi-section, one-piece garment of claim 32, wherein the posterior portion contains at least one fastener or holder for securing strip of fabric or flag.

44. The multi-section, one-piece garment of claim 32, wherein the superior regions of the anterior portion are shaped in a convex configuration, the convex configuration providing space for receiving breasts.

45. The multi-section, one-piece garment of claim 32, wherein the inferior-most regions of the pair of lateral portions are shaped in a concave configuration, the concave configuration providing space for receiving the hip.

46. The multi-section, one-piece garment of claim 32, wherein at least one slot or opening located on the interior or exterior surface or the first or third layer of the multi-layered padding, or in the seam where the first and third layers are joined to form the shell, which may or may not have a fastening device or devices to secure it in a closed position, allows for the removal or insertion of the second layer, or a layer or layers, or a portion or portions, or a section or sections thereof, from the vest.

47. The multi-section, one-piece garment of claim 32, wherein the multi-layered padding, or a portion or portions and/or a layer or layers and/or a section or sections thereof, being comprised of air-permeable and/or moisture-control/wicking material to allow for the cooling of the underlying torso.

48. The multi-section, one-piece garment of claim 32, wherein the first layer and/or second layer and/or third layer of the multi-layered padding, or portions or sections thereof, are comprised of multiple layers.

49. The multi-section, one-piece garment of claim 32, wherein a protective pad or pads comprising rigid, semi-rigid or flexible material are affixed onto, and/or inserted into a pocket on, the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, of the anterior portion and sized and shaped to provide protection from impact to the hear and/or spleen, the protective pad or pads being removable and insertable by the wearer, with access to the interior of the shell provided via either the slot or opening that allows for the removal or insertion of the second, or middle layer of the multi-layer padding from the vest, or a separate slot or located opening on the interior or exterior surface of the shell, or in the seam where the first and third layers of the multi-layer padding are joined to form the shell, which may or may not be secured in a closed position by a fastening device or devices.

50. The multi-section, one-piece garment of claim 32, wherein the posterior portion comprises at least one posterior portion fastener and/or the anterior portion comprises at least one anterior portion fastener, the posterior portion fastener and the anterior portion fastener being connected by a strap, the strap thus securing the posterior portion of the anterior portion.

51. The multi-section, one-piece garment of claim 32, wherein the pair of lateral portions have the multi-layered padding, or a layer or layers thereof, being comprised of elastic material.

52. The multi-section, one-piece garment of claim 32, wherein the lateral most edges of the second layer of the multi-layered padding in the anterior portion of the vest, or a layer thereof, extends over or overlaps the pair of lateral portions of the vest for the purpose of maintaining a second layer of the multi-layered padding between the first and third layers in the pair of lateral portions of the vest as the vest stretches horizontally to accommodate larger torso sizes.

53. The multi-section, one-piece garment of claim 33, wherein the shoulder portion, or a section or sections thereof, has the multi-layered padding consisting of only the outer layer and the inner layer to permit unhindered movement of the arms and neck.

54. The multi-section, one-piece garment of claim 40, wherein the lateral portions, or a section or sections thereof, has the multi-layered padding consisting of only the outer layer and the inner layer to permit unhindered movement of the legs and torso and provided for the cooling of the underlying torso.

55. The multi-section, one-piece garment of claim 35, wherein the inferior-most region of the anterior portion is shaped in either a short taper to protect the lower abdomen and allow unhindered movement of the legs, or a long taper to protect the lower abdomen and allow unhindered movement of the legs.

56. The multi-section, one-piece garment of claim 32, wherein the multi-layer padding in a portion or portions of the vest consists of only the first and third or outer and inner layers at or over openings, seams, breaks, slits, cuts or cut outs in the second, or middle layer of the multi-layer padding.

57. The multi-section, one-piece garment of claim 32, wherein the multi-layered padding, or a layer or layers thereof, is punctuated with a plurality of air holes to provide for the cooling of the underlying torso.

58. The multi-section, one-piece garment of claim 32, wherein the second, or middle layer, or a layer or layers thereof, a) in the left and/or right lateral portions, or a portion thereof, and the anterior portion, or a portion thereof, overlap and/or are interlocked and/or are connected and/or are comprised of one continuous piece, b) and/or in the left and/or right lateral portions, or a portion thereof, and the back portion, or a portion thereof, overlap, and/or are interlocked and/or are connected and/or are comprised of one continuous piece, c) and/or are comprised of one continuous piece, d) and/or are comprised of two pieces which meet in the back portion and overlap and/or are interlocked and/or are connected, e) and/or is comprised of multiple pieces which overlap and/or are interlocked and/or are connected.

59. The multi-section, one-piece garment of claim 32, wherein the posterior portion of the vest, or a layer or layers, or a section or sections thereof, is removable, being fastened to the vest by a fastening device or devices.

60. The multi-section, one-piece garment of claim 32, wherein a lateral portion or the lateral portions of the vest, or a layer or layers, or a section or sections thereof, is/are removable, being fastened to the vest by a fastening device or devices.

61. The multi-section, one-piece garment of claim 32, wherein the posterior portion and the lateral portions and/or shoulder portion of the best, or a layer or layers, or a section or sections thereof, are removable as a unit, being fastened to the vest by a fastening device or devices.

62. The multi-section, one-piece garment of claim 32, wherein the third, or inner layer of the multi-layer padding in the lateral portions and/or anterior portion and/or shoulder portion and/or posterior portion, or a layer or layers, or a section or sections thereof, is removable, being fastened to the vest by a fastening device or devices.

63. The multi-section, one-piece garment of claims 37 or 39, wherein the tapered section, or the bottom part thereof, in the inferior-most region of the posterior portion is removable from the vest, being fastened by a fastening device or devices.

64. The multi-section, one-piece garment of claim 32, wherein the shoulder portion is comprised partially, if not totally of material that provides for the cooling of the underlying torso.

65. The multi-section, one-piece garment of claim 55, wherein the tapered section, or the bottom part thereof, in the interior-most region of the anterior portion is removable from the vest, being fastened to the vest by a fastening device or devices.

66. The multi-section, one-piece garment of claim 32, wherein an inferior section and a superior section of the anterior portion and/or the lateral portions and/or the posterior portion overlap, are interlocked, or abutted, the overlap, interlock or abutment being secured by a fastening device or devices to attach the inferior section and the superior section together, the fastening device or devices allowing for the removal of the inferior section to change the vest length and/or the overlap, interlock or abutment, and the related fastening device or devices securing the overlap, interlock or abutment, being adjustable to change the vest length.

67. The multi-section, one-piece garment of claim 32, wherein a right section and a left section of the shoulder portion each comprise an anterior section and a posterior section, the respective anterior and posterior sections of the right and left shoulder sections overlapping or interlocking, the overlap or interlock being secured by a fastening device or devices to hold the respective anterior and posterior sections of the right and left shoulder sections together, the overlap or interlock being adjustable to provide for a change in the vest length.

68. The multi-section, one-piece garment of claim 32, wherein a right section and a left section of the shoulder portion each comprise an anterior section, a posterior section and a middle section, the respective anterior and posterior sections of the right and left shoulder sections overlapping or interlocking with the middle section, the overlap or interlock being secured by a fastening device or devices to hold the respective anterior, posterior and middle sections of the right and left shoulder sections together, the overlap or interlock being adjustable to provide for a change in the vest length.

69. The multi-section, one-piece garment of claim 32, wherein a right section and a left section of the shoulder portion each comprise an anterior section, a posterior section and a middle section, the respective anterior and posterior sections of the right and left shoulder sections overlapping or interlocking with the middle section, the respective anterior and posterior sections of the right and left shoulder sections being capable of overlapping or interlocking with each other, the overlap or overlaps or interlock or interlocks being secured by a fastening device or devices to hold the respective anterior, posterior and middle sections of the right and left shoulder sections together, the overlap or overlaps or interlock or interlocks being adjustable to provide for a change in the vest length.

70. A multi-section, one-piece garment for protecting against impact upon a human torso when worn by an athlete during sporting activities, the multi-section, one-piece garment comprising:

a vest sized and shaped to be worn on a torso of an athlete, the vest comprising an anterior portion, a posterior portion, a pair of lateral portions and a shoulder portion, the vest having a multi-layered padding in the anterior portion and the shoulder portion and/or the lateral portions and/or the posterior portion of the vest to protect the torso of the athlete, the multi-layered padding having three layers, wherein the first, or outer layer and the third, or inner layer of the multi-layered padding sandwich, or are joined at a seam to provide a shell for, the second, or middle layer, the second layer being formed from a padding material for protecting against impact to the torso, the posterior portion and/or the lateral portions and/or the shoulder portions of the vest being comprised primarily, if not totally of material that provides for the cooling of the underlying torso, the vest having an offset opening or offset openings, the offset opening or offset openings being located offset from the medial line of a human torso to protect the heart against impact, the vest having a fastening device or devices, the fastening device or devices being fastened to secure the vest about the torso.

71. The multi-section, one-piece garment of claim 70, wherein the shoulder portion having the multi-layered padding sized and shaped to provide protection to the shoulder area and permit unhindered movement of the arms and neck, the shoulder portion further having a pair of oversized apertures located at the lateral most regions for receiving the arms, each oversized aperture being sized and shaped to permit full movement of the arm.

72. The multi-section, one-piece garment of claim 70, wherein the shoulder portion having the multi-layered padding, or a layer or layers thereof, being comprised of elastic material.

73. The multi-section, one-piece garment of claim 70, wherein the shoulder portion is comprised primarily, if not totally of material that provides for the cooling of the underlying torso.

74. The multi-section, one-piece garment of claim 70, wherein the anterior portion has the multi-layered padding sized and shaped to allow unhindered movement of the legs and to protect against impact to the chest, heart, spleen and abdomen.

75. The multi-section, one-piece garment of claim 70, wherein the posterior portion has the multi-layered padding sized and shaped to protect against impact to the back.

76. The multi-section, one-piece garment of claim 75, wherein the inferior-most region of the posterior portion is shaped in either a short taper to protect the back and allow the unhindered movement of the legs, or a long taper to provide protection to the lower spine area and allow unhindered movement of the legs.

77. The multi-section, one-piece garment of claim 70, wherein the posterior portion is comprised primarily, if not totally of material that provides for the cooling of the underlying torso.

78. The multi-section, one-piece garment of claim 77, wherein the posterior portion has a tapered section in the inferior-most region, the taper being comprised of a padding material or a multi-layer padding wherein the inner and outer layer or layers sandwich or provide a shell for the middle layer or layers to provide protection to the lower spine area.

79. The multi-section, one-piece garment of claims 76 or 78, wherein the tapered section, or the bottom part thereof, in the inferior-most region of the posterior portion is removable from the vest, being fastened by a fastening device or devices.

80. The multi-section, one-piece garment of claim 70, wherein the pair of lateral portions has the multi-layered padding sized and shaped to allow unhindered movement of the legs and to protect against impact to the lateral regions.

81. The multi-section, one-piece garment of claim 70, wherein the pair of lateral portions are comprised primarily, if not totally of material that provides for the cooling of the underlying torso.

82. The multi-section, one-piece garment of claim 70, wherein at least one single or multi-part adjustable securing belt-like device such as a belt, strap or drawstring is wrapped around the multi-layered padding, or partially thereof, on the first, or outer layer, the second, or middle layer, or a layer thereof, or the first and second layer alternately, of the vest to secure the vest about the torso, the adjustable securing belt-like device being fastened to the vest by a fastening means and/or inserted through a vertical loop or loops and/or a slot or slots and/or an opening or openings, the vertical loop or loops being attached to the vest and the slot or slots and/or opening or openings being located in the first, or outer layer and/or the third, or inner layer of the vest to hold the adjustable securing belt-like device around the torso, the adjustable securing belt-like device being fastened by a belt-like device fastener or fasteners.

83. The multi-section, one-piece garment of claim 70, wherein the posterior portion contains at least one fastener or holder for securing a removable strip of fabric or flag.

84. The multi-section, one-piece garment of claim 70, wherein the superior regions of the anterior portion are shaped in a convex configuration, the convex configuration providing space for receiving breasts.

85. The multi-section, one-piece garment of claim 70, wherein the inferior-most regions of the pair of lateral portions are shaped in a concave configuration, the concave configuration providing space for receiving the hip.

86. The multi-section, one-piece garment of claim 70, wherein an overlap or overlaps and/or a flap or flaps extending or being located over the offset opening or offset openings and sized and shaped to protect the region of the offset openings or offset openings against impact and cover the area of the vest about the offset opening or offset openings, the overlap or overlaps and/or the flap or flaps extending from or being attached to the vest and fastened across the offset opening or offset openings by a fastening device or devices to secure the vest on the torso, the fastening device or devices either supplementing or supplanting the fastening device or devices fastened to secure the vest about the torso.

87. The multi-section, one-piece garment of claim 86, wherein the overlap or overlaps and/or the flap or flaps contains at least one fastener attached on its exterior surface and correspondingly on the exposed exterior surface of the vest to secure the overlap or overlaps and/or the flap or flaps in an open position on the vest.

88. The multi-section, one-piece garment of claim 86, wherein the superior region of the overlap or overlaps and/or the flap or flaps is shaped in a convex configuration, the convex configuration providing space for receiving breasts.

89. The multi-section, one-piece garment of claim 70, wherein the multi-layered padding, or a portion or portions and/or a layer or layers and/or a section or sections thereof, being comprised of air-permeable and/or moisture-control/wicking material to allow for the cooling of the underlying torso.

90. The multi-section, one-piece garment of claim 70, wherein at least one slot or opening located on the interior or exterior surface or the first or third layer of the multi-layered padding, or in the seam where the first and third layers are joined to form the shell, which may or may not have a fastening device or devices to secure it in a closed position, allows for the removal or insertion of the second layer, or a layer or layers, or a portion or portions, or a section or sections thereof, from the vest.

91. The multi-section, one-piece garment of claim 70, wherein the first layer and/or second layer and/or third layer of the multi-layered padding, or portions or sections thereof, are comprised of multiple layers.

92. The multi-section, one-piece garment of claim 70, wherein the posterior portion comprises at least one posterior portion fastener and/or the anterior portion comprises at least one anterior portion fastener, the posterior portion fastener and the anterior portion fastener being connected by a strap, the strap thus securing the posterior portion to the anterior portion.

93. The multi-section, one-piece garment of claim 70, wherein a protective pad or pads comprising rigid, semi-rigid or flexible material are affixed onto, and/or inserted into a pocket on, the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, of the anterior portion and sized and shaped to provide protection from impact to the heart and/or spleen, the protective pad or pads being removable and insertable by the wearer, with access to the interior of the shell provided via either the slot or opening that allows for the removal or insertion of the second, or middle layer of the multi-layer padding from the vest, or a separate slot or located opening on the interior or exterior surface of the shell, or in the seam where the first and third layers of the multi-layer padding are joined to form the shell, which may or may not be secured in a closed position by a fastening device or devices.

94. The multi-section, one-piece garment of claim 71, wherein the shoulder portion, or a section or sections thereof, has the multi-layer padding consisting of only the outer layer and the inner layer to permit unhindered movement of the arms and neck.

95. The multi-section, one-piece garment of claim 80, wherein the lateral portions, or a section or sections thereof, has the multi-layered padding consisting of only the outer layer and the inner layer to permit unhindered movement of the legs and torso and provide for the cooling of the underlying torso.

96. The multi-section, one-piece garment of claim 74, wherein the inferior-most region of the anterior portion is shaped in either a short taper to protect the lower abdomen and allow unhindered movement of the legs, or a long taper to protect the lower abdomen and allow unhindered movement of the legs.

97. The multi-section, one-piece garment of claim 70, wherein the multi-layer padding in a portion or portions of the vest consists of only the first and third or outer and inner layers at or over openings, seams, breaks, slits, cuts or cut outs in the second, or middle layer of the multi-layer padding.

98. The multi-section, one-piece garment of claim 70, wherein the multi-layered padding, or a layer or layers thereof, is punctuated with a plurality of air holes to provide for the cooling of the underlying torso.

99. The multi-section, one-piece garment of claim 70, wherein the posterior portion of the vest, or a layer or layers, or a section or sections thereof, is removable, being fastened to the vest by a fastening device or devices.

100. The multi-section, one-piece garment of claim 70, wherein a lateral portion or the lateral portions of the vest, or a layer or layers, or a section or sections thereof, is/are removable, being fastened to the vest by a fastening device or devices.

101. The multi-section, one-piece garment of claim 70, wherein the posterior portion and the lateral portions and/or shoulder portion of the vest, or a layer or layers, or a section or sections thereof, are removable as a unit, being fastened to the vest by a fastening device or devices.

102. The multi-section, one-piece garment of claim 70, wherein the third, or inner layer of the multi-layer padding in the lateral portions and/or anterior portion and/or shoulder portion and/or posterior portion, or a layer or layers, or a section or sections thereof, is removable, being fastened to the vest by a fastening device or devices.

103. The multi-section, one-piece garment of claim 70, wherein the second, or middle layer, or a layer or layers thereof, a) in the left and/or right lateral portions, or a portion thereof, and the anterior portion, or a portion thereof, overlap and/or are interlocked and/or are connected and/or are comprised of one continuous piece, b) and/or in the left and/or right lateral portions, or a portion thereof, and the back portion, or a portion thereof, overlap, and/or are interlocked and/or are connected and/or are comprised of one continuous piece, c) and/or are comprised of one continuous piece, d) and/or are comprised of two pieces which meet in the back portion and overlap and/or are interlocked and/or are connected, e) and/or is comprised of multiple pieces which overlap and/or are interlocked and/or are connected.

104. The multi-section, one-piece garment of claim 96, wherein the tapered section, or the bottom part thereof, in the inferior-most region of the anterior portion is removable from the vest, being fastened to the vest by a fastening device or devices.

105. The multi-section, one-piece garment of claim 70, wherein an inferior section and a superior section of the anterior portion and/or the lateral portions and/or the posterior portion overlap, are interlocked, or abutted, the overlap, interlock or abutment being secured by a fastening device or devices to attach the inferior section and the superior section together, the fastening device or devices allowing for the removal of the inferior section to change the vest length and/or the overlap, interlock or abutment, and the related fastening device or devices securing the overlap, interlock or abutment, being adjustable to change the vest length.

106. The multi-section, one-piece garment of claim 70, wherein a right section and a left section of the shoulder portion each comprise an anterior section and a posterior section, the respective anterior and posterior sections of the right and left shoulder sections overlapping or interlocking, the overlap or interlock being secured by a fastening device or devices to hold the respective anterior and posterior sections of the right and left shoulder sections together, the overlap or interlock being adjustable to provide for a change in the vest length.

107. The multi-section, one-piece garment of claim 70, wherein a right section and a left section of the shoulder portion each comprise an anterior section, a posterior section and a middle section, the respective anterior and posterior sections of the right and left shoulder sections overlapping or interlocking with the middle section, the overlap or interlock being secured by a fastening device or devices to hold the respective anterior, posterior and middle sections of the right and left shoulder sections together, the overlap or interlock being adjustable to provide for a change in the vest length.

108. The multi-section, one-piece garment of claim 70, wherein a right section and a left section of the shoulder portion each comprise an anterior section, a posterior section and a middle section, the respective anterior and posterior sections of the right and left shoulder sections overlapping or interlocking with the middle section, the respective anterior and posterior sections of the right and left shoulder sections being capable of overlapping or interlocking with each other, the overlap or overlaps or interlock or interlocks being secured by a fastening device or devices to hold the respective anterior, posterior and middle sections of the right and left shoulder sections together, the overlap or overlaps or interlock or interlocks being adjustable to provide for a change in the vest length.

109. A multi-section, one-piece garment for protecting against impact upon a human torso when worn by an athlete during sporting activities, the multi-section, one-piece garment comprising:

a vest sized and shaped to be worn on a torso of an athlete, the vest having a multi-layered padding to protect the torso of the athlete including a chest, an abdomen, a pair of lateral regions, a shoulder area and a back, the vest further comprising a shoulder portion, an anterior portion, a pair of lateral portions, a posterior portion and an offset opening or offset openings, the multi-layered padding having three layers, wherein the first, or outer layer and the third, or inner layer of the multi-layered padding sandwich, or are joined at a seam to provide a shell for, the second, or middle layer, the second layer being formed from a padding material for protecting against impact to the torso, the shoulder portion having a pair of oversized apertures located at the lateral most regions for receiving the arms, each oversized aperture being sized and shaped to permit full movement of the arm, the offset opening or offset openings being offset from the medial line of a human torso to protect the heart against impact;

the vest having a fastening device or devices, the fastening device or devices being fastened to secure the vest about the torso.

110. The multi-section, one-piece garment of claim 109, wherein the anterior portion and pair of lateral portions have the multi-layered padding sized and shaped to allow unhindered movement of the legs and protect the chest, heart, spleen, abdomen and lateral regions against impact.

111. The multi-section, one-piece garment of claim 110, wherein the pair of lateral portions have the multi-layered padding, or a layer or layers thereof, being comprised of elastic material.

112. The multi-section, one-piece garment of claim 109, wherein the lateral most edges of the second layer of the multi-layered padding in the anterior portion and/or posterior portion of the vest, or a layer thereof, extend over and/or overlap in the pair of lateral portions of the vest for the purpose of maintaining a second layer of the multi-layered padding between the first and third layers in the pair of lateral portions of the vest as the vest stretches horizontally to accommodate larger torso sizes.

113. The multi-section, one-piece garment of claim 109, wherein the shoulder portion has the multi-layered padding sized and shaped to provide protection to the shoulder area and permit unhindered movement of the arms and neck, the shoulder portion further having a pair of oversized apertures located at the lateral most regions for receiving the arms, each oversized aperture being sized and shaped to permit full movement of the arm.

114. The multi-section, one-piece garment of claim 113, wherein the shoulder portion having the multi-layered padding, or a layer or layers thereof, being comprised of elastic material.

115. The multi-section, one-piece garment of claim 109, wherein the posterior portion has the multi-layered padding sized and shaped to protect the back against impact.

116. The multi-section, one-piece garment of claim 109, wherein the second layer of the multi-layered padding material being formed from polymeric cellular foam to protect the torso against impact.

117. The multi-section, one-piece garment of claim 109, wherein at least one single or multi-part adjustable securing belt-like device such as a belt, strap or drawstring is wrapped around the multi-layered padding, or partially thereof, on the first, or outer layer, the second, or middle layer, or a layer thereof, or the first and second layer alternately, of the vest to secure the vest about the torso, the adjustable securing belt-like device being fastened to the vest by a fastening means and/or inserted through a vertical loop or loops and/or a slot or slots and/or an opening or openings, the vertical loop or loops being attached to the vest and the slot or slots and/or opening or openings being located in the first, or outer layer and/or the third, or inner layer of the vest to hold the adjustable securing belt-like device around the torso, the adjustable securing belt-like device being fastened by a belt-like device fastener or fasteners.

118. The multi-section, one-piece garment of claim 109, wherein the superior region of the anterior portion is shaped in a convex configuration, the convex configuration providing space for receiving breasts.

119. The multi-section, one-piece garment of claim 109, wherein the inferior-most regions of the pair of lateral portions are shaped in a concave configuration, the concave configuration providing space for receiving the hip.

120. The multi-section, one-piece garment of claim 109, wherein the posterior portion contains at least one fastener or holder for securing a removable strip of fabric or flag.

121. The multi-section, one-piece garment of claim 109, wherein the multi-layered padding, or a portion or portions and/or a layer or layers and/or a section or sections thereof, being comprised of air-permeable and/or moisture-control/wicking material to allow for the cooling of the underlying torso.

122. The multi-section, one-piece garment of claim 109, wherein the multi-layered padding, or a layer or layers thereof, is punctuated with a plurality of air holes to provide for the cooling of the underlying torso.

123. The multi-section, one-piece garment of claim 109, wherein at least one slot to opening located on the interior or exterior surface of the first or third layer of the multi-layered padding, or in the seam where the first and third layers are joined to form the shell, which may or may not have a fastening device or devices to secure it in a closed position, allows for the removal or insertion of the second layer of the multi-layered padding, or a layer or layers, or a portion or portions, or a section or sections thereof, from the vest.

124. The multi-section, one-piece garment of claim 109, wherein the first layer and/or second layer and/or third layer of the multi-layered padding, or portions or sections thereof, is comprised of multiple layers.

125. The multi-section, one-piece garment of claim 109, wherein a protective pad or pads comprising rigid, semi-rigid or flexible material are affixed onto, and/or inserted into a pocket on, the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, of the of the anterior portion and sized and shaped to provide protection from impact to the hear and/or spleen, the protective pad or pads being removable and insertable by the wearer, with access to the interior of the shell provided via either the slot or opening that allows for the removal or insertion of the second, or middle layer of the multi-layered padding from the vest, or a separate slot or located opening on the interior or exterior surface of the shell, or in the seam where the first and third layers of the multi-layer padding are joined to form the shell, which may or may not be secured in a closed position by a fastening device or devices.

126. The multi-section, one-piece garment of claim 115, wherein the posterior portion being shaped in a tapered design in the inferior-most region to provide protection to the lower spine area and allow unhindered movement of the legs.

127. The multi-section, one-piece garment of claim 109, wherein the posterior portion comprises at least one posterior portion fastener and/or the anterior portion comprises at least one anterior portion fastener, the posterior portion fastener and the anterior portion fastener being connected by a strap, the strap thus securing the posterior portion to the anterior portion.

128. The multi-section, one-piece garment of claim 113, wherein the shoulder portion, or a section or sections thereof, has the multi-layered padding consisting of only the outer layer and the inner layer to permit unhindered movement of the arms and neck.

129. The multi-section, one-piece garment of claim 110, wherein the lateral portions, or a section or sections thereof, has the multi-layered padding consisting of only the outer layer and the inner layer to permit unhindered movement of the legs and torso and provide for the cooling of the underlying torso.

130. The multi-section, one-piece garment of claim 109, wherein the multi-layer padding in a portion or portions of the vest consists of only the first and third or outer and inner layers at or over openings, seams, breaks, slits, cuts or cut outs in the second, or middle layer of the multi-layer padding.

131. The multi-section, one-piece garment of claim 109, wherein the third, or inner layer of the multi-layer padding, or a layer or layers, or a portion or portions, or a section or sections thereof, is removable, being fastened to the vest by a fastening device or devices.

132. The multi-section, one-piece garment of claim 126, wherein the tapered section, or the bottom part thereof, in the inferior-most region of the posterior portion is removable from the vest, being fastened by a fastening device or devices.

133. The multi-section, one-piece garment of claim 110, wherein the inferior-most region of the anterior portion is shaped in either a short taper to protect the lower abdomen and allow unhindered movement of the legs, or a long taper to protect the lower abdomen and allow unhindered movement of the legs.

134. The multi-section, one-piece garment of claim 133, wherein the tapered section, or the bottom part thereof, in the inferior-most region of the anterior portion is removable from the vest, being fastened to the vest by a fastening device or devices.

135. The multi-section, one-piece garment of claim 109, wherein an inferior section and a superior section of the anterior portion and/or the lateral portions and/or the posterior portion overlap, are interlocked or abutted, the overlap, interlock or abutment being secured by a fastening device or devices to attach the inferior section and the superior section together, the fastening device or devices allowing for the removal of the inferior section to change the vest length and/or the overlap, interlock or abutment, and the related fastening device or devices securing the overlap, interlock or abutment, being adjustable to change the vest length.

136. The multi-section, one-piece garment of claim 109, wherein the second, or middle layer, or a layer or layers thereof, a) in the left and/or right lateral portions, or a portion thereof, and the anterior portion, or a portion thereof, overlap and/or are interlocked and/or are connected and/or are comprised of one continuous piece, b) and/or in the left and/or right lateral portions, or a portion thereof, and the back portion, or a portion thereof, overlap, and/or are interlocked and/or are connected and/or are comprised of one continuous piece, c) and/or are comprised of one continuous piece, d) and/or are comprised of two pieces which meet in the back portion and overlap and/or are interlocked and/or are connected, e) and/or is comprised of multiple pieces which overlap and/or are interlocked and/or are connected.

137. The multi-section, one-piece garment of claim 109, wherein a right section and a left section of the shoulder portion each comprise an anterior section and a posterior section, the respective anterior and posterior sections of the right and left shoulder sections overlapping or interlocking, the overlap or interlock being secured by a fastening device or device to hold the respective anterior and posterior sections of the right and left shoulder sections together, the overlap or interlock being adjustable to provide for a change in the vest length.

138. The multi-section, one-piece garment of claim 109, wherein a right section and a left section of the shoulder portion each comprise an anterior section, a posterior section and a middle section, the respective anterior and posterior sections of the right and left shoulder sections overlapping or interlocking with the middle section, the overlap or interlock being secured by a fastening device or devices to hold the respective anterior, posterior and middle sections of the right and left shoulder sections together, the overlap or interlock being adjustable to provide for a change in the vest length.

139. The multi-section, one-piece garment of claim 109, wherein a right section and a left section of the shoulder portion each comprise an anterior section, a posterior section and a middle section, the respective anterior and posterior sections of the right and left shoulder sections overlapping or interlocking with the middle section, the respective anterior and posterior sections of the right and left shoulder sections being capable of overlapping or interlocking with each other, the overlap or overlaps or interlock or interlocks being secured by a fastening device or devices to hold the respective anterior, posterior and middle sections of the right and left shoulder sections together, the overlap or overlaps or interlock or interlocks being adjustable to provide for a change in the vest length.

140. The multi-section, one-piece garment of claim 109, wherein an overlap or overlaps and/or a flap or flaps extending or being located over the offset opening or offset openings and sized and shaped to protect the region of the offset opening or offset openings against impact and cover the area of the vest about the offset opening or offset openings, the overlap or overlaps and/or the flap or flaps extending from or being attached to the vest and fastened across the offset opening or offset openings by a fastening device or devices to secure the vest on the torso, the fastening device or devices either supplementing or supplanting the fastening device or devices fastened to secure the vest about the torso.

141. The multi-section, one-piece garment of claim 140, wherein the overlap or overlaps and/or the flap or flaps contains at least one fastener attached on its exterior surface and correspondingly on the exposed exterior surface of the vest to secure the overlap or overlaps and/or the flap or flaps in an open position on the vest.

142. The multi-section, one-piece garment of claim 140, wherein the superior region of the overlap or overlaps and/or the flap or flaps is shaped in a convex configuration, the convex configuration providing space for receiving breasts.

* * * * *